United States Patent [19]

Mima

[11] Patent Number: 4,703,651

[45] Date of Patent: Nov. 3, 1987

[54] AUTOMATIC INSPECTING APPARATUS FOR YARN JOINING DEVICE

[75] Inventor: Hiroshi Mima, Joyo, Japan

[73] Assignee: Murata Kikai Kabushiki Kaisha, Kyoto, Japan

[21] Appl. No.: 808,851

[22] Filed: Dec. 13, 1985

[30] Foreign Application Priority Data

Dec. 17, 1984 [JP] Japan ..... 59-266933

[51] Int. Cl.[4] ..... G01L 5/04

[52] U.S. Cl. ..... 73/160

[58] Field of Search ..... 73/826, 828, 159, 160, 73/834, 160, 865.8

[56] References Cited

U.S. PATENT DOCUMENTS

| | | | |
|---|---|---|---|
| 2,590,398 | 3/1952 | Gegenschatz | 73/828 |
| 3,294,326 | 12/1966 | Raasch | 73/160 |
| 3,795,906 | 3/1974 | Erbstein | 73/160 |
| 3,919,886 | 11/1975 | Chambley | 73/160 |
| 4,116,393 | 9/1978 | Inouye et al. | 73/160 |
| 4,173,787 | 11/1979 | Katona et al. | 73/828 |
| 4,411,128 | 10/1983 | Mima | 57/22 |

*Primary Examiner*—Stewart J. Levy
*Assistant Examiner*—Robert R. Raevis
*Attorney, Agent, or Firm*—Spensley Horn Jubas & Lubitz

[57] ABSTRACT

An automatic inspecting apparatus for yarn joining device comprising a joining command mechanism which provides a drive command to a joining device in a take-up unit, a yarn sampling mechanism for cutting and holding a certain length of a sample yarn including a joint portion after joining, directly from a yarn travelling path in the take-up unit, a transfer mechanism for transferring the sample yarn up to a measuring apparatus, a setting mechanism for separating the sample yarn from the transfer mechanism and setting it to a measuring position in the measuring apparatus, and a measuring mechanism measuring characteristics of the thus-set sample yarn.

17 Claims, 35 Drawing Figures

AUTOMATIC INSPECTING APPARATUS FOR YARN JOINING DEVICE

FIELD OF THE INVENTION AND RELATED ART STATEMENT

The present invention relates to an automatic inspecting apparatus for a yarn joining device.

In an automatic winder, in order to remove defects of yarn being wound, the yarn is cut positively once a thick or fine yarn portion or a slub is detected by a yarn defect detector called a slub catcher. During joining a defective portion is removed by suction into a suction pipe and only a non-defective yarn portion is wound up onto a take-up package, which is then fed to a subsequent knitting or weaving step.

Therefore, in such an automatic winder for positively performing yarn cutting and joining, it is essential to provide an automatic joining device and various joining devices have heretofore been used such as, for example, a joining device called a knotter which forms a mechanical knot such as Fisherman's knot or Weaver's knot, and a pneumatic splicing device which forms a knot-free joint by combining or intertwisting yarn portions by the use of on air current.

The joints formed after joining by such joining devices are required to have sufficient strength, elongation and appearance and to this end it is necessary to thoroughly check and inspect the joining performance of a joining device attached to a winder which is in operation in a spinning mill, or a joining device of a winder being delivered from an automatic winder manufacturing factory.

Such inspection has heretofore been conducted in the following manner. For example, a package which has become fully loaded in a take-up unit is moved to a measuring room, where a worker samples a certain length of a yarn portion including a joint while detecting the joint portion and then sets the sample yarn to a measuring apparatus, followed by a tensile test to measure its strength and elongation, and whether the joining device attached to the winder which has taken up the said package is good or not is judged from the results of the measurement.

Thus, in the case where the inspection is performed by a worker, an extra load may be applied before measurement to a sample yarn for measurement itself at the time of joint detection, cutting and setting to a measuring apparatus, or a characteristic of yarn itself may be changed such as untwisting or twisting of yarn when the yarn is held by the worker's hand and transferred, thus making it difficult to effect an exact measurement. Further, a large amount of time is required for a single measurement. For example, if it takes one minute to sample and measure one sample yarn and measurement is made at least ten times for a single joining device, then a total of 10 minutes are required and hence for inspection of joining devices in take-up units of 60 spindles, 600 minutes are required. Thus, extremely large amounts of labor and time have heretofore been required.

OBJECT AND SUMMARY OF THE INVENTION

It is an object of the present invention to provide an apparatus capable of inspecting such a joining device as described above automatically in a short time and capable of exactly measuring characteristics of a sample yarn and grasping the state of the joining device.

The apparatus of the present invention comprises a joining command mechanism which provides a drive command to a joining device in a take-up unit; a yarn sampling mechanism for cutting and holding a certain length of a sample yarn including a joint portion after joining, directly from a yarn travelling path in the take-up unit; a transfer mechanism for transferring the sample yarn up to a measuring apparatus; a setting mechanism for separating the sample yarn from the transfer mechanism and setting it to a measuring position in the measuring apparatus; and a measuring mechanism for measuring characteristics of the thus-set sample yarn.

In a take-up unit, upon completion of a joining operation performed in accordance with a joining command, a certain length of yarn including a joint portion is cut and held and thus sampled from the take-up unit by means of a yarn sampling mechanism, then transferred up to a yarn characteristic measuring device of an inspecting apparatus without causing an extra yarn behavior or load, and then is set to a measuring position, in which there is performed an actual joint measurement by means of a measuring mechanism. This is done at each of plural joining operations, and the state of the joining device is checked from the results of the measurement.

DETAILED DESCRIPTION OF PREFERRED EMBODIMENTS

An embodiment of the present invention will be described hereinunder with reference to the drawings.

An inspecting apparatus according to this embodiment is adapted to move along an automatic winder in which a number of take-up units are disposed side by side and each take-up unit includes a joining device.

As a joining device provided in each take-up unit there is used such a pneumatic splicing device as disclosed in U.S. Pat. No. 4,411,128. However, it is also possible to fix the inspecting apparatus of this embodiment in a predetermined certain position and replace joining devices in a take-up unit thereby effecting a check of many joining devices before delivery. The inspecting apparatus in question is applicable also to a take-up unit provided with a knotter which forms Weaver's and Fisherman's knots or another type of joining device.

Figure 1:
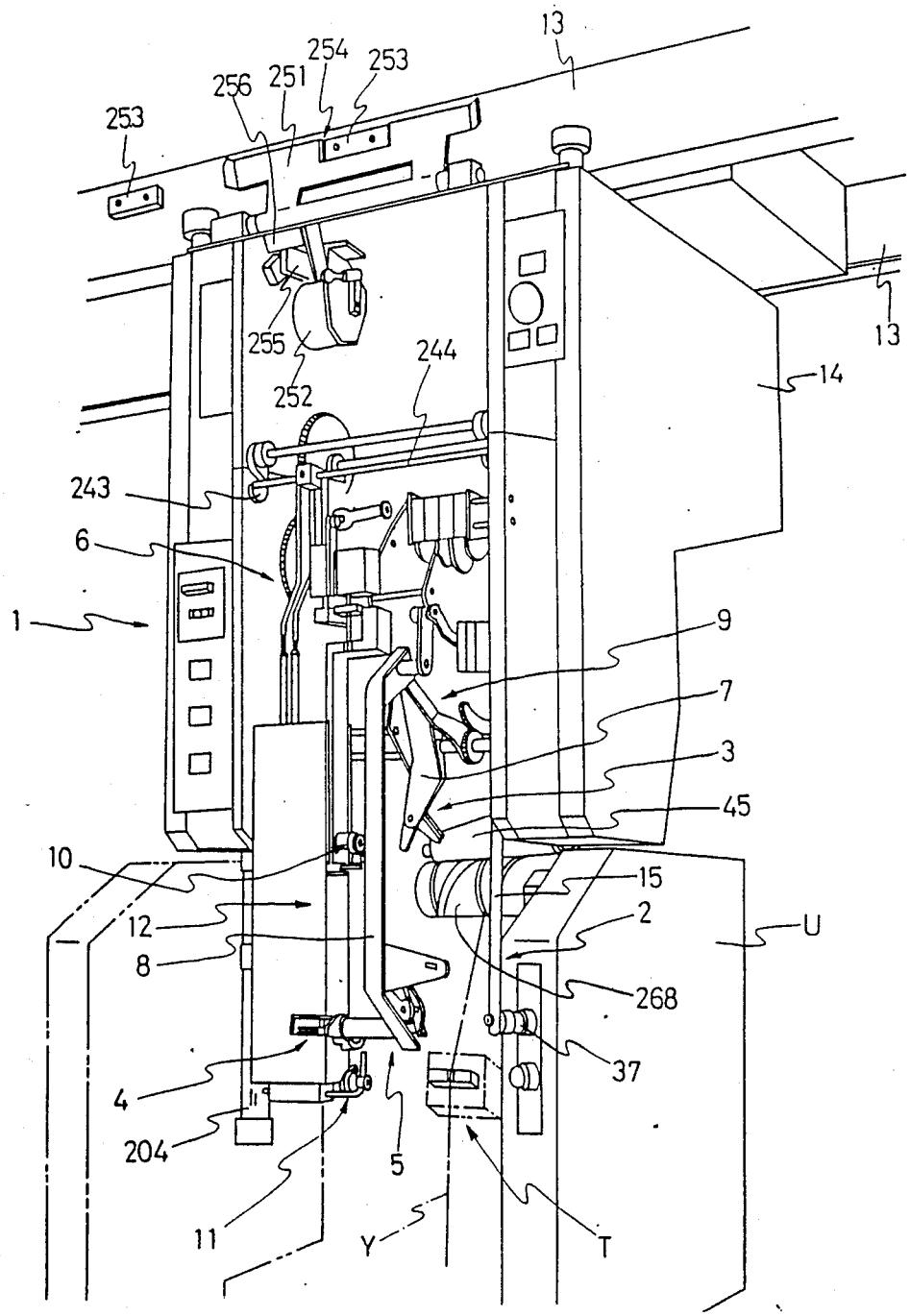
FIG. 1 is a schematic perspective view showing a construction of an inspecting apparatus embodying the invention.

With reference to FIG. 1, a schematic construction of the apparatus embodying the invention will now be explained. An inspecting apparatus 1 is composed of (i) a joining command mechanism 2 which provides a joining command to a joining device (T) of a take-up unit (U); (ii) a yarn sampling mechanism 5 which comprises an upper yarn cutting and holding mechanism 3 and a lower yarn cutting and holding mechanism 4 and which functions to cut and hold a certain length of a sample yarn including a seam portion of yarn (Y) after ending; (iii) a sample yarn transfer mechanism 9 which comprises an upper movable arm 7, a lower movable arm 8 and a link mechanism for moving the arms 7 and 8 and which functions to transfer the sample yarn thus cut and held to a measuring device 6; (iv) a setting mechanism 12 which comprises an upper clamp mechanism 10 and a lower clamp mechanism 11 and which functions to separate from the transfer mechanism the sample yarn which has been conveyed to an inspecting position; and (v) the measuring device 6 for measuring characteristics of the thus-set sample yarn.

The above components (i) to (v) are mounted on a carriage car 14 suspended through wheels from overhead rails 13 which extend along the take-up unit (U). The component mechanisms are operated while taking timing with each other, whereby sampling, transferring, setting and measuring operations for sample yarns after joining are performed in good order.

Figure 2:
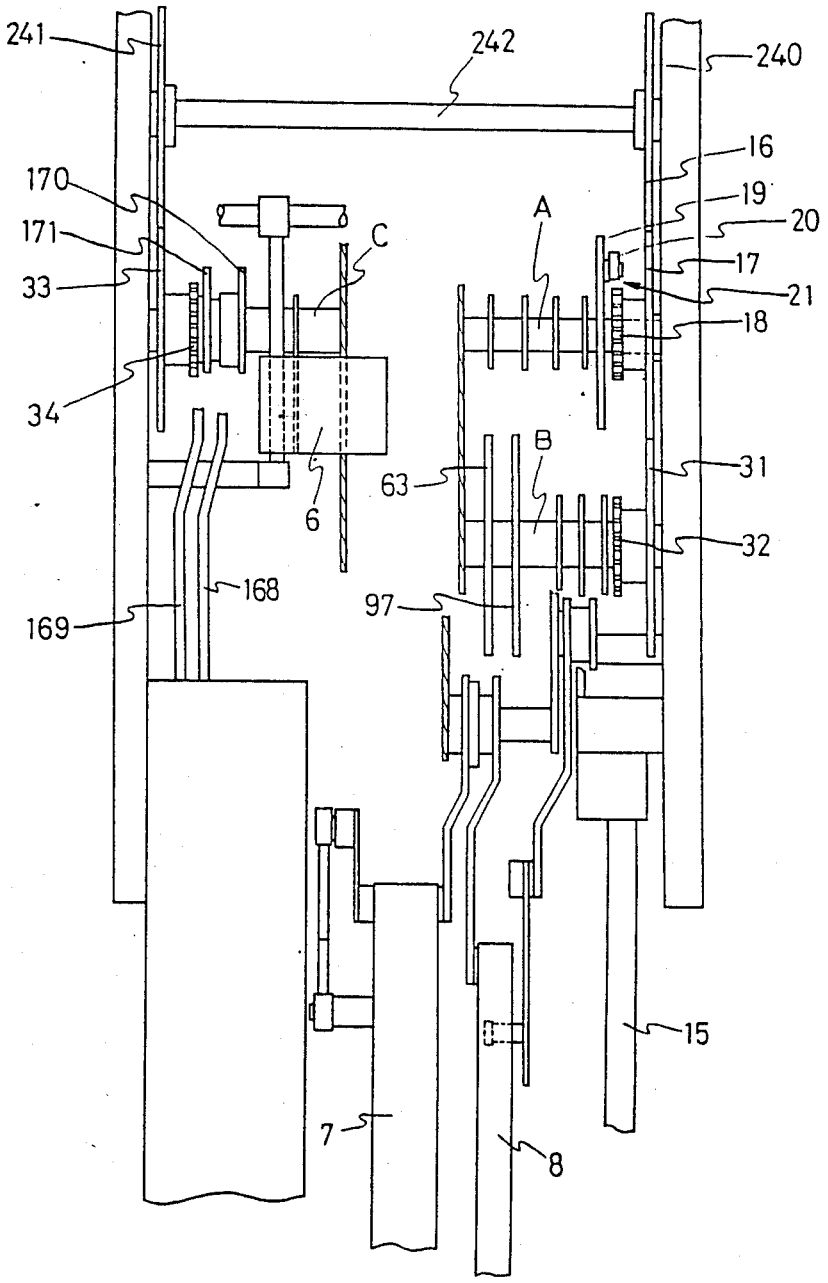
FIG. 2 is a front view showing a relation of arrangement of cam shafts (A), (B) and (C)

Referring to FIG. 2, there are shown cam shafts (A), (B) and (C) for driving the above mechanisms. More specifically, the shaft (A) actuates a joining command arm 15, the shaft (B) actuates the yarn sampling mechanism 5 and the movable arms 7 and 8 of the transfer mechanism 9, and the shaft (C) actuates the mechanism 12 for setting the sample yarn to the measuring position and also actuates the measuring mechanism 6.

The shafts (A), (B) and (C) are each disposed separately and turned on and off through a normally rotating gear and a clutch mechanism. For example, a gear 17 meshing with a gear 16 which is driven by a motor is loosely fitted on the shaft (A) shown in FIG. 2 and also fitted loosely on the shaft (A) is a ratchet wheel 18 which is integral with the gear 17. Further, a cam plate 19 is fixedly mounted on the shaft (A) and a ratchet 20 provided on the cam plate 19 is adapted to take engaged and disengaged positions selectively with respect to the ratchet wheel 18 to thereby control the rotation of the shaft (A).

Figure 3:
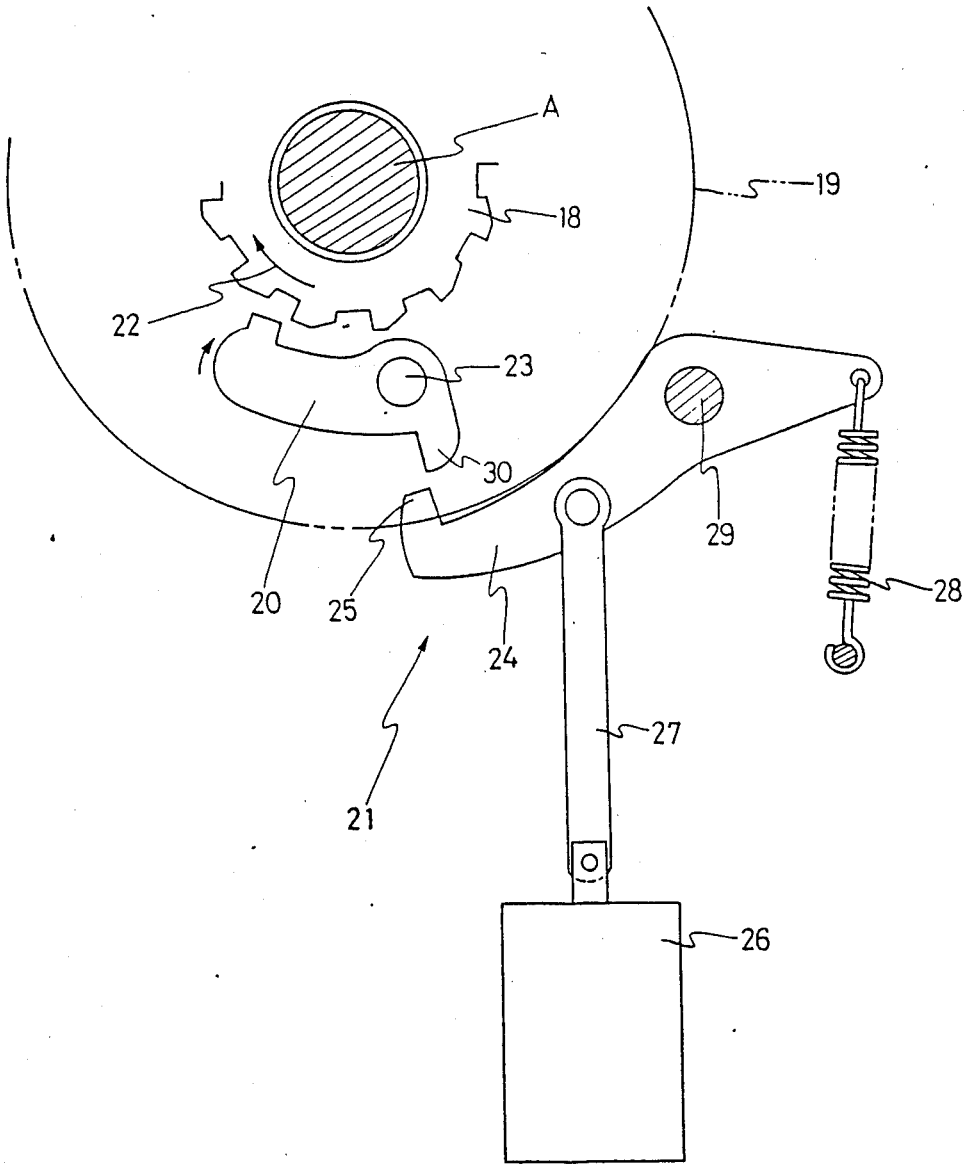
FIG. 3 is a side view showing a clutch mechanism of each cam shaft.

The clutch mechanism indicated at 21 is of such a structure as shown in FIG. 3. When the ratchet 20 pivotally secured to a side face of the cam plate 19 fixed to the shaft (A) comes into engagement with the ratchet wheel 18 which is loosely fitted on the shaft (A) and which rotates in the direction of arrow 22, the shaft (A) starts to rotate through the cam plate 19. More specifically, the ratchet 20 is urged in a clockwise direction about a shaft 23 and stands by in a position in which it is engaged with a hook 25 of a stop lever 24, namely, in a position of disengagement from the ratchet wheel 18. When a solenoid 26 connected to the stop lever 24 is energized, a rod 27 moves downward, so that the stop lever 24 pivots counterclockwise about a shaft 29 against a spring 28 and becomes disengaged from the ratchet 20. As a result, the ratchet is pivoted clockwise about the shaft 23 by the spring force and comes into engagement with the ratchet wheel 18 and so the cam plate 19 which pivotally supports the ratchet 20 rotates in the direction of arrow 22. Once the shaft (A) starts rotation, the solenoid is turned off to return the lever 24 to the original position, whereby at the end of one rotation of the shaft (A) a hook 30 comes into engagement with the lever-side hook 25 to stop the rotation of the shaft (A).

The clutch mechanism 21 of such a structure is attached to each of the shafts (A), (B) and (C) and the timing for operating the solenoid of each clutch mechanism is controlled by a control cam as will be described later. In FIG. 2, a ratchet wheel 32 integral with a gear 31 is loosely fitted on the shaft (B) and a ratchet wheel 34 integral with a gear 33 is loosely fitted on the shaft (C).

The above mechanisms will each be described below in detail.

(I) Joining Command Mechanism

Figure 4:
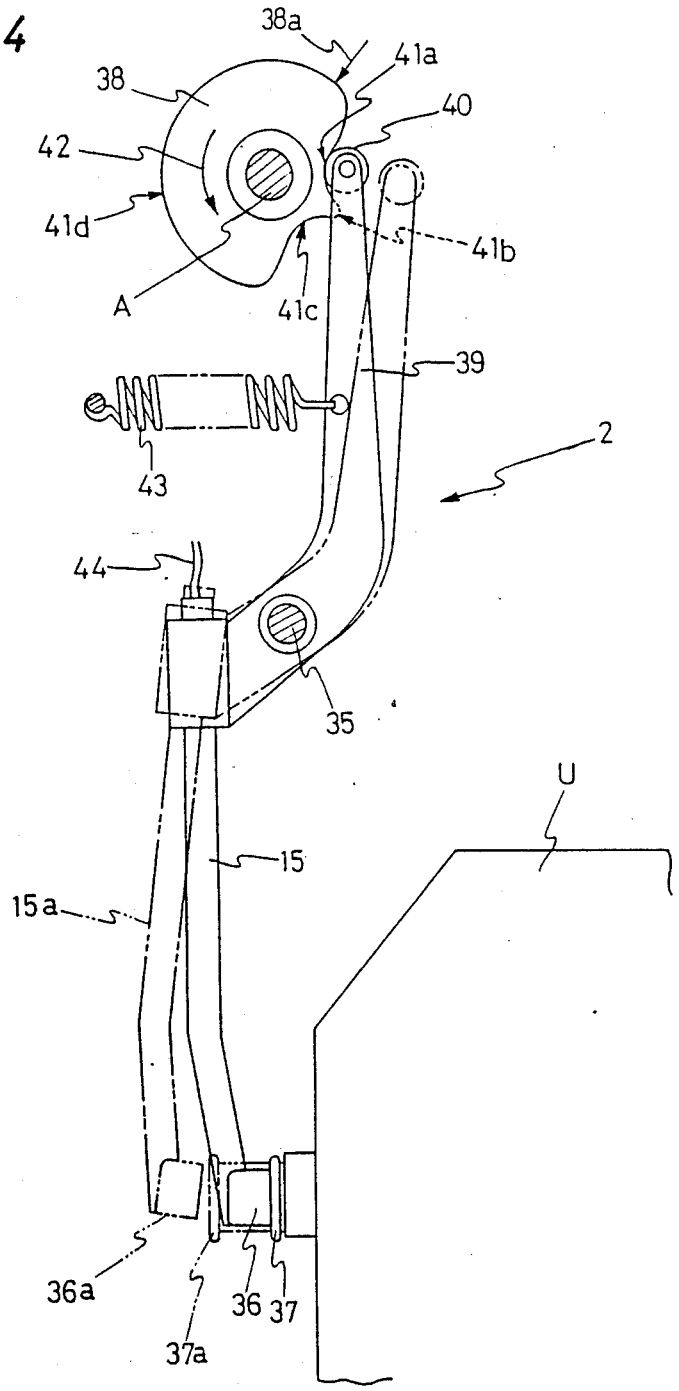
FIG. 4 is a side view showing construction and operation of a joining command arm.

In FIG. 4, the joining command mechanism 2 comprises the command arm 15 supported pivotably by a fixed shaft 35, an attracting member 36 which is an electromagnet attached to a fore end of the arm 15 and which functions to push in and out a joining control button 37 on the take-up unit side, a cam plate 38 for pivoting the arm 15, and a spring 43 which causes a cam lever 39 to follow the cam surface. The arm 15 is in the form of a pipe through which there extends an electric wire 44 for electric current to excite and deexcite the electromagnet 36.

A cam follower 40 provided at an upper end of the cam lever 39 integral with the arm 15 is changed in position by the cam plate 38 and the arm 15 is adapted to take the solid line position 15 and a dash-double dot line position 15*a*. The arm 15 normally stands by at the dash-double dot line position 15*a* and when the cam follower 40 reaches recessed portions 41*a* and 41*c* of the cam plate 38 the arm 15 is displaced to its solid line position and the attracting member 36 provided at the lower end of the arm abuts the ending control button 37 on the side of the take-up unit (U).

The joining control button 37 is positioned on the front face of the unit (U) and when it is pushed into the take-up unit, a joining start switch is turned on and a joining operation is started automatically. If this pushed-in state of the button 37 is maintained, a take-up operation is started automatically after completion of the joining operation.

If the button 37 is once pushed in and again pulled back to a dash-double dot line position 37*a* after start of the joining operation, the take-up operation of the take-up unit will not be started after completion of the joining operation and a stopped state will be maintaihed.

Thus, during the normal take-up operation, the button 37 is in its solid line position, namely, in its pushed-in position, and upon detection of a defective portion of yarn during take-up by means of a detector such as, for example, a slub catcher, the yarn is cut forcibly, the joining operation is performed automatically and the take-up operation is resumed.

In the event the joining operation is tried in vain during the automatic operation of the take-up unit (U), the joining operation is again performed and if joining is not effected even after this operation is repeated two or three times, the button 37 is pushed out to its dash-double dot line position 37*a* forcibly by a control mechanism provided within the take-up unit to stop the operation of the same unit.

Therefore, when the inspecting apparatus moves along the automatic winder in which a number of take-up units are disposed side by side, there are mixed take-up units with pushed-in button 37 and take-up units with pushed-out button 37.

On the other hand, the cam plate 38 for pivoting the arm 15 is fixed to the shaft (A) and it has a cam surface 41*d* of a large diameter, the two recessed cam surfaces 41*a*, 41*c* and a cam surface 41*b* positioned between the cam surfaces 41*a* and 41*c*. In a standstill state of the cam plate 38, the cam follower 40 is positioned on the cam surface 41*d* as indicated by an arrow 38*a* and the attracting member 36 at the arm lower end is in its dash-double dot line position 36*a*. Therefore, when the cam plate 38 rotates once in the direction of arrow 42 from this state, the joining command timing differs depending on the state of the button 37 on the take-up unit side. More particularly, in a take-up unit in which the button 37 is in its pushed-in position 37, the attracting member 36 does not act so the button 37 is not operated while the cam follower 40 reaches the first recessed portion 41*a* with rotation of the cam plate 38. When the cam follower 40 reaches the cam surface 41*b*, the attracting member 36 moves to the left while attracting the button 37, so that the button 37 is drawn out to stop the operation of the take-up unit. Further, when the cam follower 40 reaches the second recessed portion 41*c*, the arm 15 again reaches its solid line position so the button 37 is pushed in and a joining start command is provided to the take-up unit (U) side to start the joining operation. Further, when the cam follower 40 reaches the large-diameter portion 41*d*, the button 37 attracted by the attracting member 37 is drawn out so the take-up operation after completion of the joining operation is not resumed and the later-described yarn sampling, transferring, setting and measuring operations are performed.

On the other hand, where the button 37 of the take-up unit to be inspected is already projecting, the projecting button 37 is pushed in when the cam follower 40 reaches the first recessed portion 41*a* with rotation of the cam plate 38, so the joining operation is started at once. Thereafter, the cam follower 40 passes the cam surface 41*b* and the second recessed portion 41*c* and reaches the large-diameter portion 41*d*. During this period, the joining operation is continued and the pushing in and out operation of the button 37 is a lost motion.

This causes a timing error at the time of starting the yarn sampling operation as will be described later. Therefore, after the cam plate 38 performs a lost motion of one rotation, an actual yarn sampling operation is started from the time when the second rotation is performed. Thus, in any take-up unit, from the time when the cam follower 40 reaches the first recessed portion 41*a* of the cam plate 38, the other mechanisms of the inspecting apparatus are set and their timing and a control is made so that the timing of the sampling operation becomes constant.

(II) Yarn Sampling Mechanism and Transfer Mechanism

The mechanism for sampling a certain length of yarn including a joint portion of yarn extending between a yarn supply side bobbin and a take-up package after joining in the take-up unit is composed of the upper yarn cutting and holding device 3 shown in FIGS. 5 to 8 and the lower yarn cutting and holding device 4 shown in FIGS. 9 to 13. The "upper" and "lower" referred to herein indicate a take-up package (45 in FIG. 31) side and a yarn feed bobbin 46 side, respectively, with respect to the joining device (T) in the take-up unit.

Figure 5:
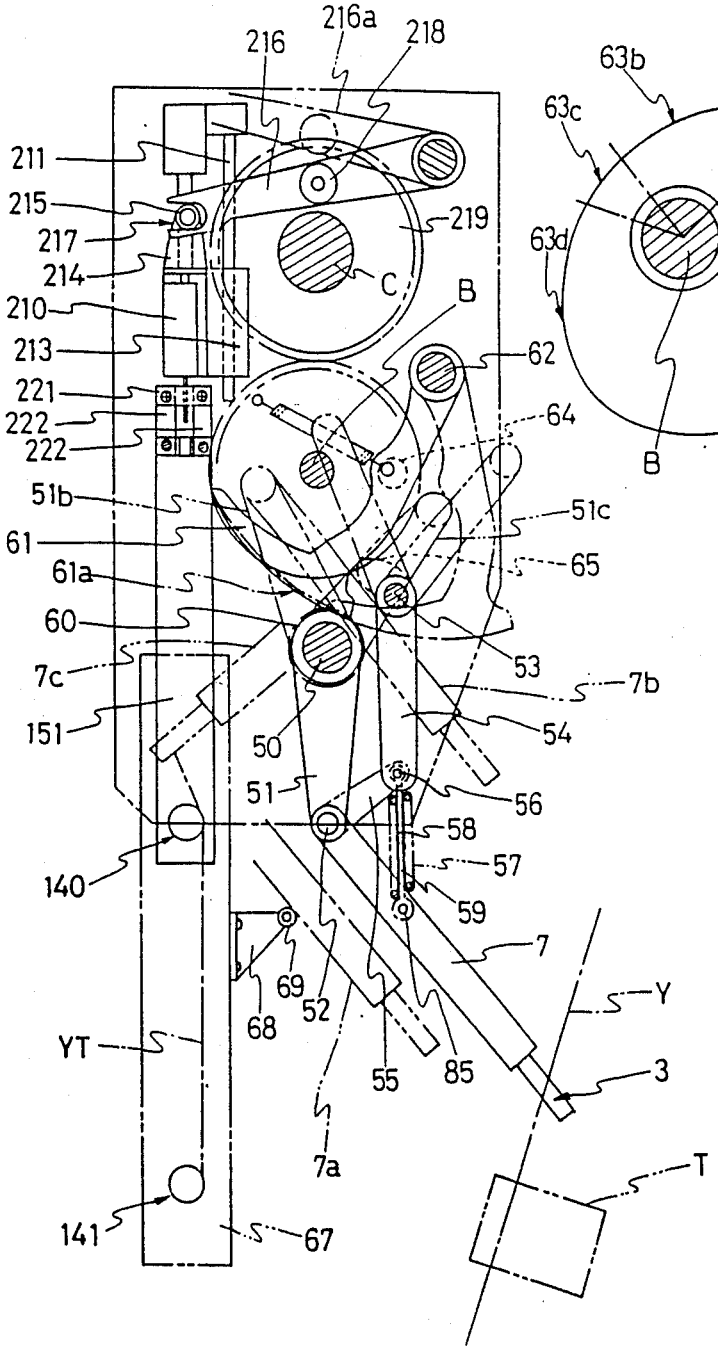
FIG. 5 is a side view showing construction and operation of an upper movable arm.

In FIG. 5, the upper yarn cutting and holding device 3 is attached to the upper movable arm 7. The arm 7 is pivoted at 52 by a first lever 51 which is pivotably supported by a fixed shaft 50, while a bar 55 is pivoted at 52 and 56 between the lever 51 and a second lever 54 which is pivotably supported by another fixed shaft 53, to form a link mechanism. Further, a tension spring 57 is connected between the shaft 56 and the arm 7, and within this spring a rod 58 which connects with the shaft 56 and a rod 59 which connects with the arm 7 are disposed face to face with each other at their end portions so that the arm 7 and the bar 55 move in parallel at a certain angle up to a specific position. After passing the specific position, only the arm 7 can pivot clockwise about the shaft 52 against the biasing force of the spring 57.

A gear 60 integral with the lever 51 is loosely fitted on the fixed shaft 50 and a segment gear 61 meshing with the gear 60 is supported pivotably about a fixed shaft 62.

Figure 6:
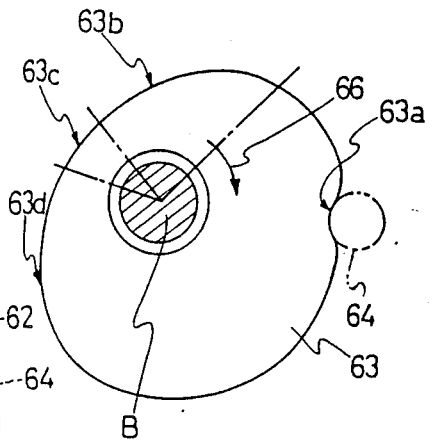
FIG. 6 is a side view of an upper movable arm driving cam.

A tooth surface 61*a* of the segment gear 61 is on a circumference centered on the shaft 62, and a cam follower 64 which is in pressure contact with a cam surface of a cam plate 63 fixed to the shaft (B) is supported through a shaft at an intermediate arm portion of the segment gear 61. As shown in FIG. 6, the cam plate 63 is formed with a recessed portion 63*a* for positioning the cam 63 and shaft (B) at certain angular positions, a descending cam surface 63*b* which allows the arm 7 to descend toward the yarn (Y), a stopping cam surface 63*c* for stopping at the bottom position and allowing the yarn cutting and holding operation to proceed, and an arm ascending cam surface 63*d* for transfer of the cut and held sample yarn up to a measuring position.

Further, to the fixed shaft 53 is fixed a cam 65 which abuts a part of the arm 7 to pivot the latter about the shaft 52.

Consequently, with rotation of the shaft (B) in the direction of arrow 66, the arm 7 descends from its standby position 7*c* until the yarn cutting and holding device 3 at the fore end of the arm reaches a specific position above the joining device (T) on the take-up unit side, whereupon the device 3 cuts and holds the yarn in such a manner as will be described later and starts ascending in synchronism with the lower movable arm. More specifically, with rotation of the cam 63 the cam follower 64 moves from the cam surface 63*c* to 63*d* and the segment gear 61 rotates counterclockwise from its solid line position 61, so that the arm 7 which is in its solid line position in FIG. 5 ascends while making a parallel movement until it passes an intermediate dash-double dot line position 7*a* and a part of the arm 7 comes into abutment with the fixed cam 65. A guide roller 69 at a tip end of a bracket 68 attached to a fixed frame 67 is a guide for allowing the arm 7 to be superposed on a straight line joining the shaft 50 of the lever 51 and the shaft 52 and allowing the subsequent parallel movement to the opposite side of the shaft 52 to be effected smoothly. It abuts the arm 7 from below to prevent inconvenient motions.

When the arm 7 reaches the position of abutment with the cam 65 and the lever 51 pivots from a dash-double dot line position 51*b* to another dash-double dot line position 51*c* with rotation of the segment gear 61, only the bar 55 connected to the lever 51 performs a parallel movement, while the arm 7 is prevented from its parallel movement by the cam 65 and moves from its dash-double dot line position 7*b* to another dash-double dot line position 7*c* while pivoting about the shaft 52 against the biasing force of the spring 57 to transfer the yarn holding point at the arm fore end to an upper clamper position of the measuring device.

Figure 8:
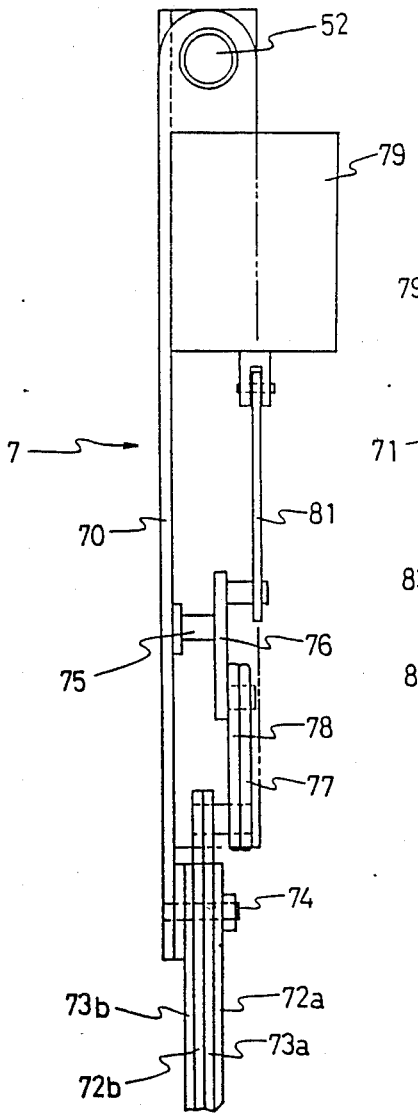
FIG. 8 is a side view thereof.

The yarn cutting and holding device attached to the upper movable arm 7 will now be explained with reference to FIGS. 7 and 8. The shaft 52 at the fore end of the lever 51 shown in FIG. 5 corresponds to the shaft 52 shown in FIGS. 7 and 8. The arm 7 is composed of a bottom plate 70 and bracket portions 71 formed by bending both side portions of the bottom plate 70 perpendicularly, and movable members 72 and 73 which constitute the yarn cutting and holding device 3 are pivoted at 74 to a fore end portion 70*a* of the bottom plate 70. As shown in FIG. 8, the movable member 72 comprises a cutter plate 72*a* and a clamp plate 72*b* which are integrally pivoted at 74 through a predetermined gap, and the other movable member 73 comprises a cutter plate 73*a* and a clamp plate 73*b* which are integrally pivoted coaxially at 74. Yarn is cut between the cutter plates 72*a* and 73*a* of the movable members 72 and 73 and a yarn end is held by the clamp plates 72*b* and 73*b*. Since the yarn cutting and holding device 3 cuts and holds a yarn portion on an upper side of the joining device in the take-up unit, the paired cutter plates 72*a* and 73*a* are located in upper positions relative to the paired clamp plates 72*b* and 73*b*, namely, on the take-up package side.

Connecting levers 77 and 78 are connected between end portions 72*c*, 73*c* of the movable members 72, 73 and a lever 76 supported by another shaft 75. To one end of the lever 76 is connected a rod 81 which is moved forward and backward by a solenoid 79 and a spring 80. Upon energization of the solenoid 79, the rod 81 moves back in the direction of arrow 82 against the spring 80 and the movable members 72 and 73 pivot about the shaft 74 in directions departing from each other and take their solid line positions. On the other hand, upon deenergization of the solenoid 79, the rod 81 moves in the direction of arrow 83 in FIG. 7 by virtue of the spring 80 and the lever 76 pivots to a dash-double dot line position 76*a*, so that the movable members 72 and 73 pivot in closing directions, whereby the sample yarn is cut and held.

A plate 84 is formed by bending a side face 71 of the upper movable arm 7 perpendicularly and it is a guide plate which is in abutment with the cam 65 shown in FIG. 5. Further, a pin 85 shown in FIG. 7 is fixed to the arm 7 and the rod 59 and spring 57 both shown in FIG. 5 are attached to the pin 85.

The lower movable arm 8 will be explained below with reference to FIGS. 9 to 13.

Figure 9:
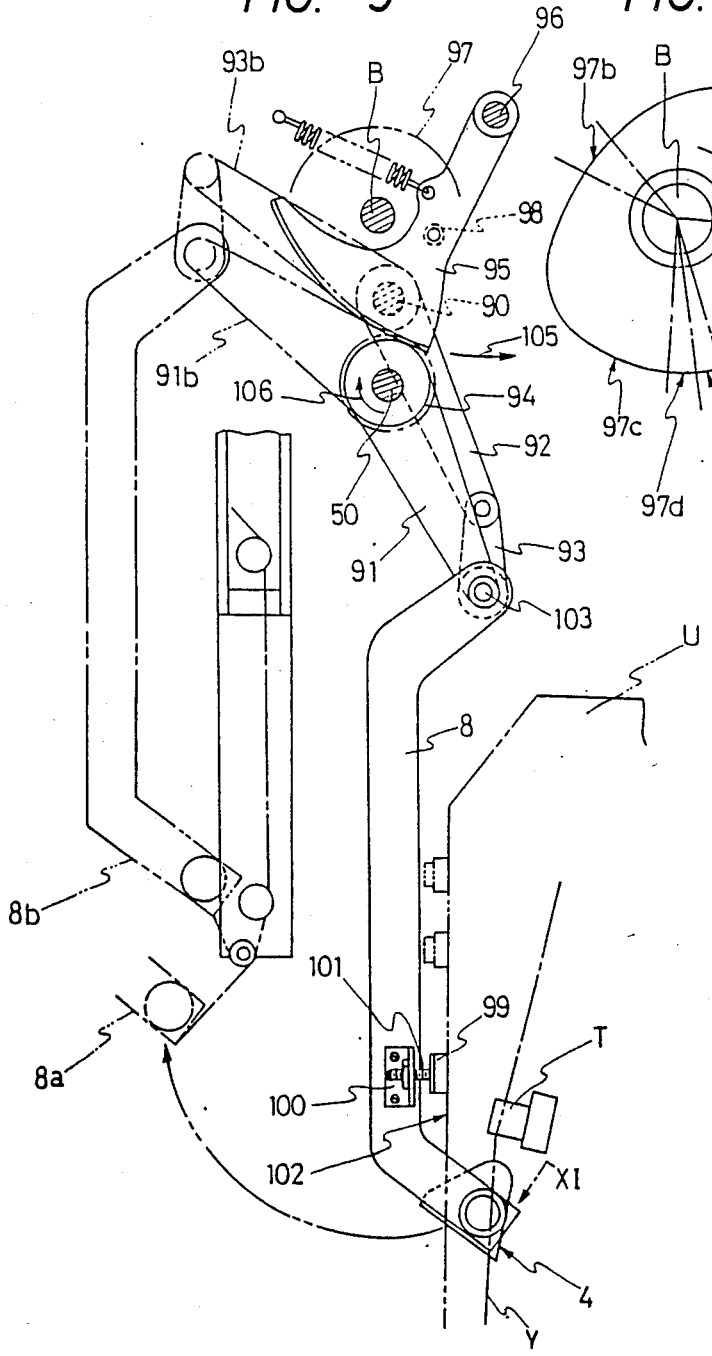
FIG. 9 is a side view showing construction and operation of a lower movable arm.

In FIG. 9, the lower movable arm 8 is integrally fixed to a connecting bar 93 connected between a pair of levers 91 and 92 which are pivotally secured to fixed shafts 50 and 90. Thus, a link mechanism is constituted by the levers 91, 92 and the bar 93, and the lower movable arm 8 makes a parallel movement with a like movement of the bar 93.

On the shaft 50 is loosely fitted a gear 94 which is integral with the lever 91, and a segment gear 95 meshing with the gear 94 is pivoted at 96. The segment gear 95 is driven by engagement of a cam plate 97 mounted on the shaft (B) with a cam follower 98 provided on the segment gear side. The gear 94 is of the same diameter and same number of teeth as the gear 60 for the upper movable arm shown in FIG. 5, and it is loosely fitted on the shaft 50. Therefore, if the segment gears 61 and 95 move at the same speed, the gears 60 and 94 also rotate at the same speed and the upper and lower movable arms 7 and 8 can make parallel movements approximately at the same speed, thus permitting movement while holding both ends of the sample yarn at a certain distance. Consequently, an extra load is not imposed on the sample yarn and it is possible to prevent elongation and breakage of the sample yarn during transfer.

The yarn cutting and holding device 4 is mounted at a lower end portion of the lower movable arm 8 whereby the yarn (Y) located below the joining device (T) on the take-up unit (U) side is out and held at a specific position. A positioning piece 99 is fixed to the arm 8 in an intermediate position. Further, a bracket 100 is fixed to the arm 8 and a screw rod 101 is threadedly engaged with the bracket 100, with the positioning piece 99 of an elastic material being fixed to the screw rod 101. When the arm 8 reaches its bottom position, the positioning piece 99 abuts a front wall face 102 of the take-up unit (U) and the yarn cutting and holding device 4 reaches the yarn cutting and holding position exactly. Since the lower movable arm 8 extends long below the support point 50 of the lever 91 or a connection point 103 thereof with the link 93, there is fear that a movement error will be enlarged by deflection at the lower end of the arm 8 or backlash of the gear 94. The positioning piece 99 is effective against these inconveniences.

Figure 10:
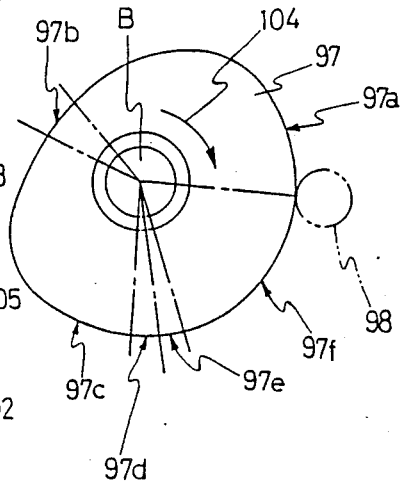
FIG. 10 is a side view of a lower movable arm driving cam.

Referring now to FIG. 10, there is illustrated the cam plate 97 which controls the movement of the lower movable arm 8. The cam plate 97 is fixed to the shaft (B) and the cam follower 98 on the side of the segment gear 95 follows the cam surface, allowing the arm 8 to move through the gear 94 and the link mechanism. The cam plate 97 has an arm lowering cam surface 97*a* whose distance from the center of rotation gradually decreases along a rotational direction 104 of the cam plate 97; a stopping cam surface 97*b* for holding the arm 8 in its bottom position to allow the yarn cutting and holding operation to proceed; a cam surface 97*c* for raising the arm while holding the yarn, the distance of the cam surface 97*c* from the center increasing gradually along the rotational direction of the cam plate; a cam surface 97*d* for temporarily stopping the ascent of the arm during yarn setting to the measuring position as will be described later; a cam surface 97*e* for a slight ascent; and a cam surface 97*f* for holding the arm in its uppermost position. These cam surfaces are formed continuously in the rotational direction of the cam plate.

For example, the solid line position of the arm 8 shown in FIG. 9 indicates a state of the arm when the cam follower 98 of the segment gear 95 has reached the cam face 97*b*. As the cam plate 97 rotates in the direction of arrow 104 in FIG. 10 from this state, the segment gear 95 rotates in a counterclockwise direction 105 about the shaft 96, while the gear 94 rotates in a clockwise direction 106, so that the arm 8 makes a parallel movement through the levers 91, 92 and the bar 93 and moves from its intermediate position 8*a* to its uppermost position 8*b*.

The lower yarn cutting and holding device mounted at the lower end of the lower movable arm will be explained below with reference to FIGS. 11 to 13.

Figure 11:
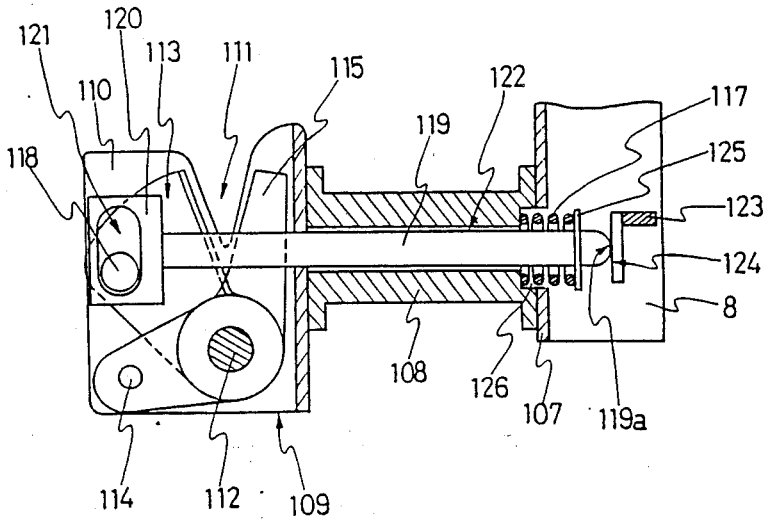
FIG. 11 is a partially sectional plan view of a lower yarn cutting and holding device.
Figure 12:
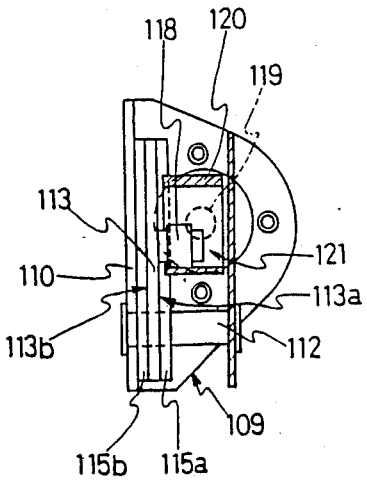
FIG. 12 is a side view thereof.

FIG. 11 is a partially sectional plan view viewed in the direction of arrow (XI) in FIG. 9, and FIG. 12 is a left side view of FIG. 11. One end face of a cylindrical support 108 is fixed to a side plate 107 of the lower movable arm 8 with bolts or by welding, and to the other end face of the support 108 is fixed a side face of an L-shaped bracket 109 which supports the movable members and fixed members as the constituents of the yarn cutting and holding device. A yarn guide V groove 111 is formed in the bottom of the bracket 109 and on both sides of the groove 111 are provided a movable member 113 which is pivotable about a shaft 112 and a fixed member 115 which is fixed with a pin 114. As shown in FIG. 12, the fixed member 115 comprises two plates 115*a* and 115*b* which are fixed so that a gap is formed therebetween to permit admission of the movable member 113 between the plates 115*a* and 115*b*. Yarn is cut between an upper surface 113*a* of the movable member and the clamp plate 115*a*.

Figure 13:
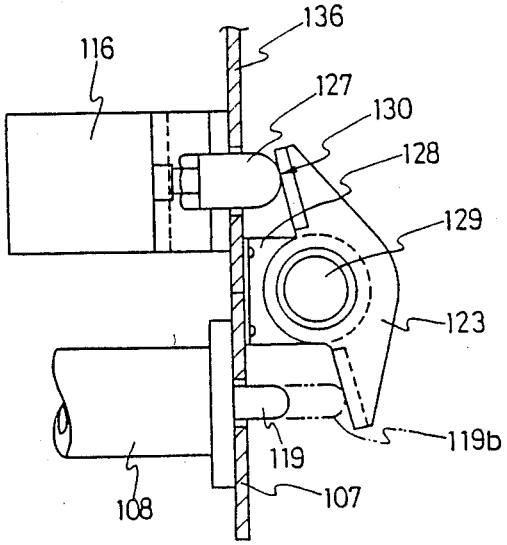
FIG. 13 is a partially sectional front view showing a drive source for the lower yarn cutting and holding device.

The movable member 113 is driven by a fluid cylinder 116 shown in FIG. 13 and a spring 117 shown in FIG. 11. A pin 118 is fixed to the upper surface of the movable member 113 so that it is positioned within a long hole 121 formed in a block 120 which is fixed to a slide rod 119. The rod 119 extends through a center bore 122 of the cylindrical support 108 and projects from the side wall 107 of the arm 8 so that an end portion 119*a* thereof abuts a pressing face 124 of a rocking plate 123. A compression spring 117 is disposed between a washer 125 fixed to the rod 119 and a cylindrical recess 126 formed in the support 108 and it urges the rod 119 rightwards in FIG. 11. On the other hand, another bracket 136 is fixed to the side wall 107 of the arm 8 and a fluid cylinder 116 having a piston rod 127 adapted to slide in parallel with the rod 119 is fixed to the bracket 136 as shown in FIG. 13. Further, the rocking plate 123 for transmitting the movement of the piston rod 127 to the rod 119 connected to the movable member is pivotally secured at 129 to a bracket 128 on the arm side. On one side of the rocking plate 123 is formed a pressing face 130 which abuts a fore end of the piston rod 127 and on the other side thereof is formed the pressing face 124 which abuts a fore end of the rod 119. These pressing faces are bent approximately perpendicularly to the paper surface and in directions opposite to each other.

Therefore, the piston rod 127 is normally in its retreated position shown in FIG. 13, the rod 119 is held in a position projecting rightward from the support 108 by the biasing force of the spring 117, and the movable member 113 is in a closed position At the time of yarn cutting and holding operation, the piston rod 127 once advances under the action of the fluid cylinder 116, thereby causing the rocking plate 123 to pivot clockwise from its position shown in FIG. 13, so that the rod 119 is pushed in from its dash-double dot line position 119*b* to its solid line position 119 against the spring 117. With movement of the block 120 connected to the rod 119, the movable member 113 pivots about the shaft 112 in FIG. 11 through the pin 118 and reaches its position shown in FIG. 11, namely, a preparatory position for yarn cutting and holding operation. In this state, after the arm 8 moves up to a position in which the yarn enters the V groove 111, the fluid cylinder 116 is switched over to withdraw the piston rod 127, so that the rod 119 moves rightwards under the action of the spring 117 and the movable member 113 closes. Thus the yarn cutting and holding operation is completed.

Figure 14:
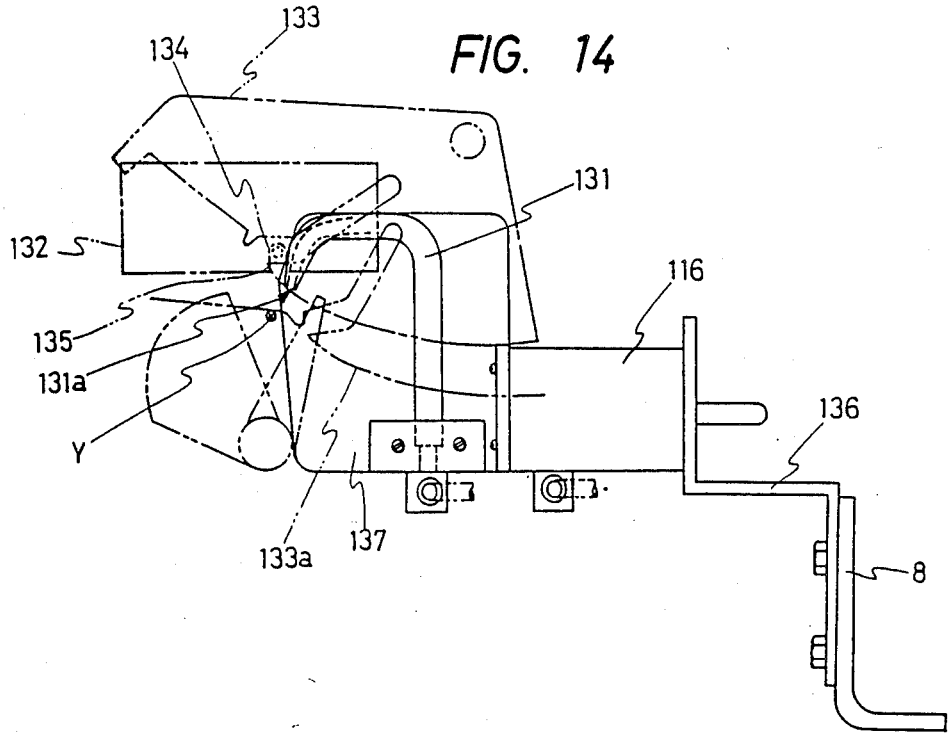
FIG. 14 is a plan view showing construction and operation of a yarn ejecting nozzle.
Figure 15:
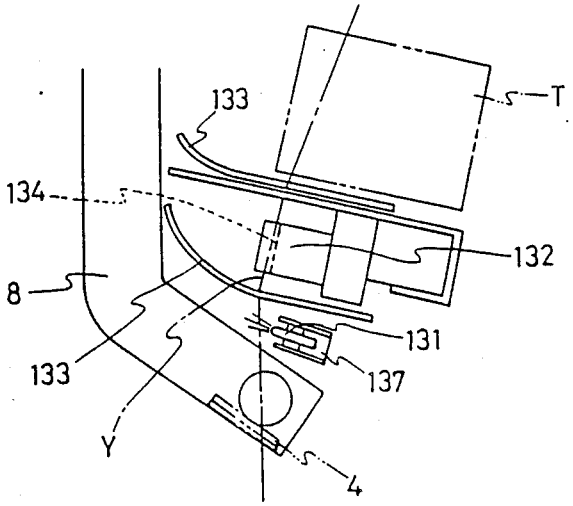
FIG. 15 is a side view showing an operating position of the above nozzle.

An air jet nozzle 131 as shown in FIGS. 14 and 15 is attached to the lower movable arm 8. In the take-up unit, a detecting device 132 for detecting a defective yarn portion such as slub is disposed below the joining device (T) as shown in FIG. 15. After completion of the joining operation, the yarn is pushed into a slit 134 of the detecting device 132 by pivoting of upper and lower levers 133, and a part 135 of the lever 133 is so positioned as to cover the front face of the slit 134 to prevent the yarn from jumping out accidentally. Therefore, when the lever 133 returns from its dash-double dot line position 133*a* to another dash-double dot line position 133 after completion of the joining operation, it is desirable to prevent the yarn (Y) on the lever 133 from entering the slit 134 of the detecting device 132.

To this end, the air jet nozzle 131 is provided in this embodiment.

The nozzle 131 is attached through a support plate 137 to an end face of the fluid cylinder for the yarn cutting and holding device which cylinder is attached to a bracket 136 fixed to the lower movable arm 8, as shown in FIG. 14. Air is ejected from an opening 131*a* of the nozzle 131 toward the yarn (Y) after completion of joining and in a direction in which the yarn does not enter the slit 134 of the yarn detecting device 132. The nozzle 131 is disposed between the yarn cutting and holding device 4 and the yarn detecting device 132, as shown in FIG. 15.

The timing of air injection from the nozzle 131 is controlled by a valve change-over cam as will be described later.

(III) Mechanism for Setting Sample Yarn to Measuring Device

Figure 16:
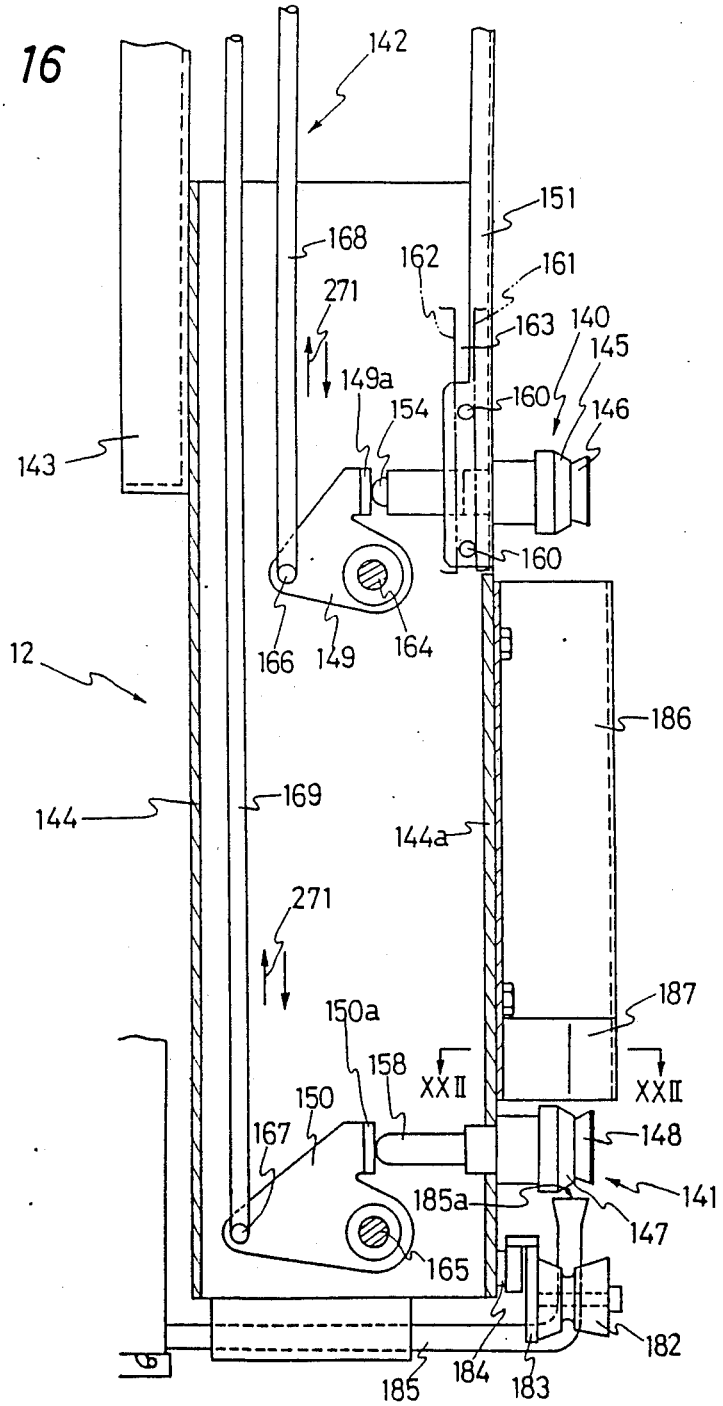
FIG. 16 is a partially sectional front view of a sample yarn setting mechanism provided on the side of a measuring mechanism.

The sample yarn including a joint portion which has been conveyed to the measuring device by the yarn sampling mechanism and transfer mechanism is set and clamped at both ends thereof to a predetermined certain position by the setting mechanism 12 shown in FIG. 16.

In FIGS. 16 to 19, the setting mechanism 12 is composed of an upper clamp mechanism 140 for clamping an upper end portion of the sample yarn, a lower clamp mechanism 141 for clamping a lower end portion of the sample yarn, and a drive mechanism 142 for driving both mechanisms.

The upper and lower clamp mechanisms are provided on the side of one side wall 144*a* of a box member 144 of square-shaped section in plan fixed in to a body frame 143 of the inspecting apparatus 1 shown in FIG. 1. The upper clamp mechanism 140 is movable in a vertical direction along the box member 144, while the position of the lower clamp mechanism 141 is fixed. In this case, characteristics such as tenacity and elongation of the sample yarn can be measured by an upward movement of the upper clamp mechanism.

Figure 17:
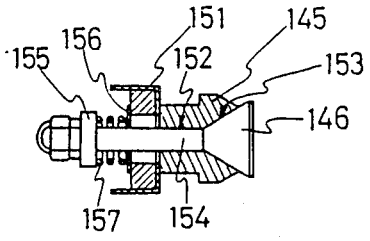
FIG. 17 is a sectional front view of upper and lower clamp mechanisms.
Figure 18:
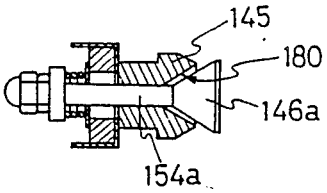
FIG. 18 is a sectional view showing an open state of a movable piece thereof.
Figure 19:
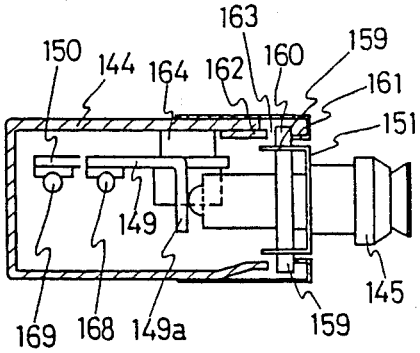
FIG. 19 is a plan view showing a construction of the upper clamp mechanism.

The upper and lower clamp mechanisms 140 and 141 are principally composed of fixed pieces 145 and 147, movable pieces 146 and 148 for clamping yarn between them and the fixed pieces 145, 147, and actuating levers 149 and 150 for actuating the movable pieces 146 and 148. As shown in FIGS. 17 and 18, the fixed piece 145 fixed to a lift plate 151 has a center hole 152 and a conical recess 153, and a rod 154 extending through the center hole 152 is formed with a conical convex-like movable piece 146 which is in close contact with the above conical recess. A compression spring 157 is mounted between a washer 155 fixed to the rod 154 and a ring 156 fixed to the lift plate 151 side and it urges the movable piece 146 leftwards to clamp a yarn end portion between the tapered contact surfaces of the fixed piece 145 and the movable piece 146. Of course, the clamp portion may be a simple plane portion, not a conical taper.

Since the lower clamp mechanism 141 is fixed its position with respect to the box member 144, the fixed piece 147 of the same shape as above is directly fixed to the side wall 144*a* of the box member 144 and a rod 158 having the movable piece 148 extends through a center hole of the fixed piece and the side wall 144*a* and projects to the interior of the box member 144.

Further, the lift plate 151 of the upper clamp mechanism 140 is formed by bending a plate in a bracket-shape in plan view, and between bent faces 159 are provided guide pins 160 in two upper and lower positions (160 and 160 in FIG. 16). The pins 160 are adapted to move vertically along gaps 163 between guide rails 161 and 162 formed on the box member 144.

In the lowermost position of the upper movable piece 146 the actuating lever 149 having a pressing face 149*a* is secured to the box member 144 pivotally at 164 in a position opposed to the rod 154 of the movable piece 146, and also in a position opposed to the rod 158 of the lower movable piece 148 the actuating lever 150 having a similar pressing face 150*a* is secured to the box member 144 pivotally at 165. Actuating rods 168 and 169 connected respectively at 166 and 167 to the levers 149 and 150 are moved up and down by a later-described cam mechanism, whereby the movable pieces 146 and 148 are opened and closed in synchronism therewith to clamp upper and lower yarn end portions.

Figure 20:
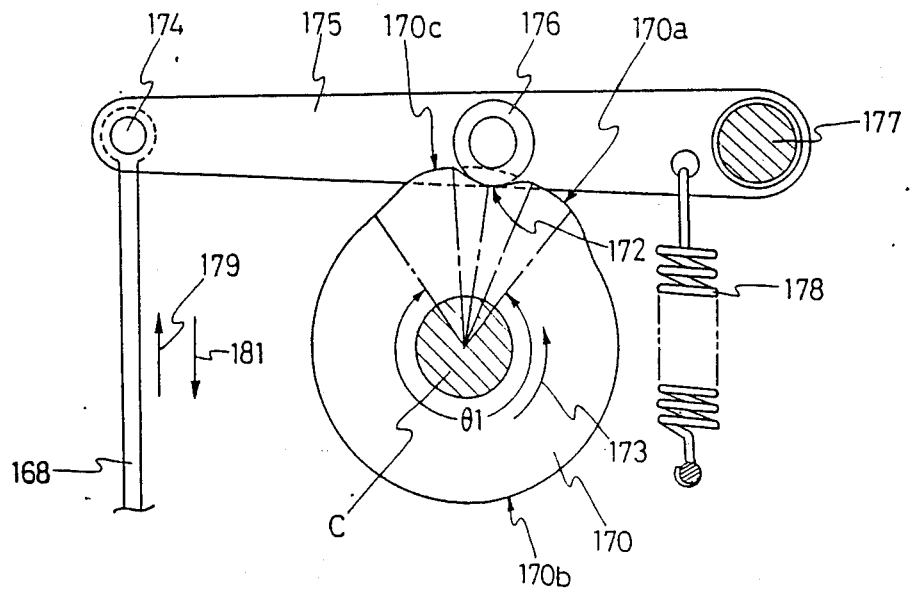
FIG. 20 is a side view showing a drive mechanism for a movable piece in the upper and lower clamp mechanisms.

FIG. 20 illustrates a cam mechanism for operating the actuating rods 168 and 169. Two cam plates (170 and 171 in FIG. 2) are fixed to the shaft (C). One cam plate 170 is for the upper clamp mechanism, while the other cam plate 171 is for the lower clamp mechanism, both having about the same cam surface, merely different in that a cam shaft stop-positioning recess 172 is present on one cam surface. Therefore, only one cam 170 will be explained below.

The cam plate 170 rotates in the direction of arrow 173. Its cam surface comprises a large-diameter portion 170*a*, then a small-diameter portion 170*b* formed over an angle of $\theta 1$ and further a large-diameter portion 170*c*. A cam follower 176 provided at an intermediate part of a cam lever 175 which at a fore end supports the actuating rod 168 pivotally at 174 is in pressure contact with the above cam surface. The lever 175 is supported by a fixed shaft 177 and is urged by a spring 178 in a direction in which the cam follower 176 comes into pressure contact with the cam surface.

In the state shown in FIG. 20, the cam follower 176 is in the recess 172, so the rod 168 is in its lowered position and the upper movable member 146 is in its closed position. With rotation of the cam plate 170, the cam follower 176 follows the large-diameter portion 170*a*, the lever 175 pivots in a clockwise direction, the actuating rod 168 rises in the direction of arrow 179, the lever 149 at the lower end of the rod 168 shown in FIG. 16 pivots clockwise about the shaft 164, and the pressing face 149*a* presses the rod 154 on the side of the movable piece 146 to open the movable piece 146 against the spring force and create the state shown in FIG. 18, namely, form a conical gap 180 between the fixed piece 145 and the movable piece 146*a*. In this state the sample yarn is conveyed up to a predetermined position, whereupon it is positioned to a position in which it crosses the above gap vertically. And with rotation of the cam plate 170, the cam follower 176 reaches the small-diameter portion 170*b*, whereupon the actuating rod 168 goes down in the direction of arrow 181 and causes the movable piece 146 to revert to the original state to clamp the yarn. The actuating rod 168 is in its lower position over the angle $\theta 1$, during which there is made a yarn tenacity test. When the cam follower 176 reaches the cam surface position 170*c*, the lift plate 151 assumes the original state, namely, its lowermost position, and the actuating rod 168 is again raised by the large-diameter portion 170*c* to open the movable piece 146 and unclamp the yarn end. While taking timing with this motion, a suction air stream acts on a yarn waste suction pipe disposed near the unclamping position, whereby upper and lower broken yarn wastes after measurement are removed.

Figure 21:
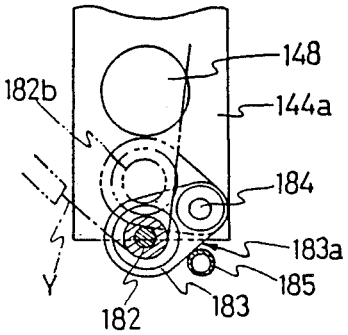
FIG. 21 is a side view showing a yarn-slack removing weight roller disposed just under the lower clamp mechanism.

In FIG. 16, a weight roller 182 for removing a slack of the sample yarn is disposed just under the lower clamp mechanism 141. It is mounted on a lever 183 which is secured to the side wall 144*a* of the box member pivotably at 184. A lower side of the lever 183 is positioned by abutment of its lower edge 183*a* onto a yarn waste suction pipe 185. In setting yarn, the yarn is wound round the weight roller 182, allowing the lower movable arm (8*a* in FIG. 9) to move, and when the lower movable arm further moves after the upper movable arm reaches a predetermined certain position, the weight roller 182 can be moved from its solid line position shown in FIG. 21 to its dash-double dot line 182*b* under the tension of the yarn (Y). Thus the yarn slack is removed and the sample yarn can be set under a certain initial tension. The weight of the weight roller 182 and lever 183 does not cause a change in characteristics of the sample yarn; it corresponds to a mere slack removing weight. The roller 182 may be replaced according to the thickness of yarn.

Figure 22:
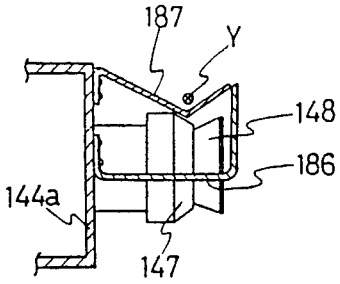
FIG. 22 is a sectional view taken on line XXII—XXII of FIG. 16.

Further, as shown in FIGS. 16 and 22, in order to prevent the yarn after breakage from being entangled to the upper and lower movable arms and the yarn cutting and holding mechanism under the influence of air stream or the like from the take-up unit side between the upper and lower yarn end clamp mechanisms 140 and 141 and to position the yarn near the yarn waste suction pipe exactly, a yarn entanglement preventing plate 186 having a generally L-shaped section is attached to the side wall 144*a* of the box member as shown in FIG. 22. A generally V-shaped guide plate 187 is attached to the side wall 144*a* of the box member 144 in a position close to an upper portion of the lower clamp mechanism 141 so that the sample yarn (Y) being transferred by the lower movable arm is sure to be guided between the fixed piece 147 and the movable piece 148. The guide plate 187 may be provided also in the position of the upper clamp mechanism, but in this embodiment a later-described yarn detecting feeler is provided just under the upper clamp mechanism and the sample yarn is guided to a predetermined certain position by the said feeler, so the guide plate 187 is provided only on the lower side.

Figure 23:
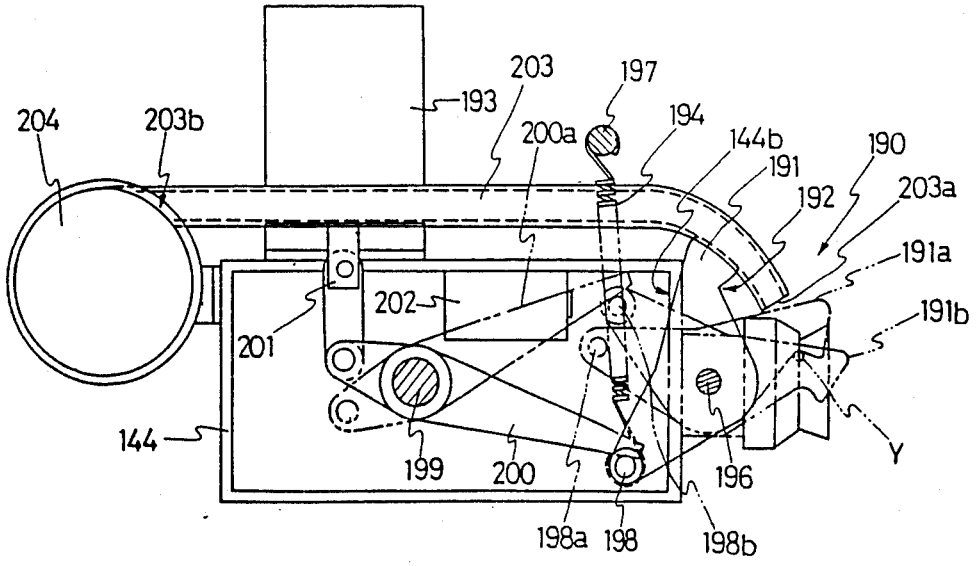
FIG. 23 is a plan view showing construction and operation of a sample yarn detecting device disposed just under the upper clamp mechanism.
Figure 24:
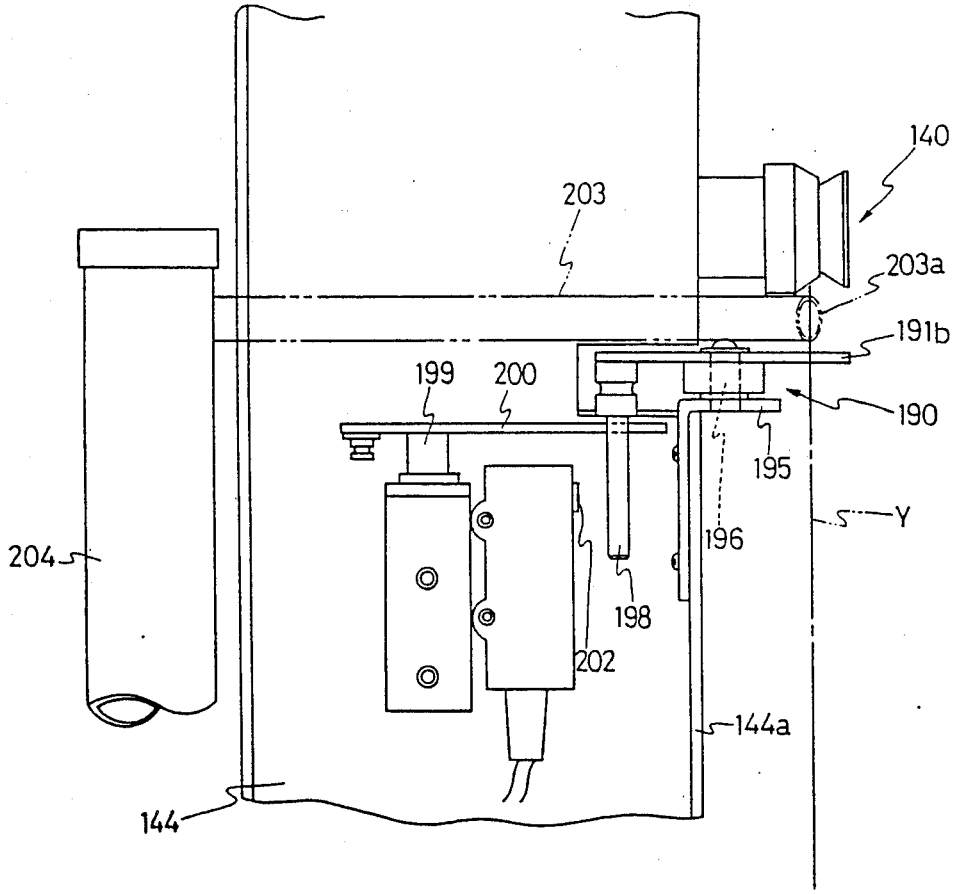
FIG. 24 is a front view thereof.

The following description is now provided with reference to FIGS. 23 and 24 about a yarn detecting device 190 for detecting whether a sample yarn is set in the measuring position or not.

The detecting device 190 is disposed just under the lowermost position of the upper clamp mechanism 140 and it is composed of a feeler 191 having a hook portion 192 capable of being displaced by the tension of the sample yarn (Y), a solenoid 193 for operating the feeler 191, and a spring 194 which imparts a weak urging force to the feeler 191.

A bracket 195 is fixed to the box member 144 and the feeler 191 which is in the shape of a lever is secured onto the bracket 195 pivotably at 196. As shown in FIG. 23, the feeler 191 is movable between a stand-by position indicated by a solid line and a pivoted position 191b in the absence of yarn in which the feeler pivots across the sample yarn position (Y) set between the upper and lower clamp mechanisms. At one end of the feeler 191 is formed a hook portion 192 which engages the sample yarn (Y), while to the other end thereof is connected the tension spring 194 which is retained by a fixed pin 197 provided on the box member side, whereby the feeler 191 is urged clockwise about the shaft 196.

The strength of the spring 194 should be weak so that where the sample yarn is present when the feeler 191 pivots clockwise from its solid line position under the spring force alone, the pivotal movement of the feeler is prevented by the yarn and the feeler stops at an intermediate position 191*a* without moving up to the dash-double dot line position 191*b*. It is desirable to change the spring force according to the thickness of yarn, but if the feeler does not induce yarn breakage under the force of a spring also in the case of a yarn of the smallest tenacity, the same spring is applicable also to other yarns.

To the other end portion of the feeler 191 is fixed a downwardly depending detection pin 198 and a lever 200 pivotable about a shaft 199 is in abutment with the pin 198 to effect positioning of the feeler 191. The lever 200, which is connected to a solenoid rod 201, is normally in its solid line position 200, and when detecting whether yarn is present or not, the lever 200 is moved to a dashdouble dot line position 200*a* by turning on or off of the solenoid 193, and the feeler 191 follows the lever 200 and pivots. The reference numeral 202 denotes a reflection type phototube sensor, which detects whether the pin 198 is present or not in an irradiated position to thereby judge whether yarn is present or not. In this case, a black paint for suppressing the reflection of light is applied to the pin 198, and if a white tape is sticked to a light-reflective position 144*b* on the inner surface of the box member 144, it will be more effective.

For the detection of yarn, the lever 200 pivots up to its dash-double dot line position 200*a* and the feeler 191 turns clockwise under the force of the spinning 194. In the absence of yarn, the feeler 191 turns up to the position in which it abuts the lever 200*a*. In this position, the pin 198*b* of the feeler 191*b* is positioned in front of the phototube sensor 202 so the amount of reflected light incident on the sensor 202 becomes less or zero. On the other hand, where the yarn (Y) is present in the measuring position, the feeler 191 stops in the position 191*a* of engagement with the yarn (Y), the pin 198 occupies an intermediate position 198*a* and reflected light is incident on the sensor 202. In this way, whether yarn is present or not is detected while taking timing. This detecting operation is performed in a slack-free state in which both ends of yarn are clamped by the upper and lower clamp mechanisms, and prior to start of the measuring operation as will be described later.

As shown in FIGS. 23 and 24, an opening 203*a* of an upper yarn waste removing suction pipe 203 is positioned near the lowest position of the upper clamp mechanism 140. The suction pipe 203 is fixedly attached to the box member 144 and pressure air from a pressure air supply source (not shown) is fed to the interior of the suction pipe 203 so as to create an air stream flowing toward a yarn waste storage box 204 located sideways. The yarn waste storage box 204 is a cylindrical box, and an end opening 203*b* of the upper suction pipe 203 and an end opening of the lower suction pipe 185 in FIG. 16 are positioned tangentially on the inner peripheral surface of the box. A wire gauze for air vent is stretched over the upper and lower surfaces of the box and yarn wastes once sucked are stored as a compact yarn waste lump into the box while being intertwined, without being disturbed, by a rotating flow in a certain direction. The yarn waste lump can be discharged easily by forming the lower surface of the box as a detachable lid.

(IV) Sample Yarn Measuring Mechanism

Since the tenacity of joint is measured in this embodiment, a tension tester is used as the measuring device.

Figure 25:
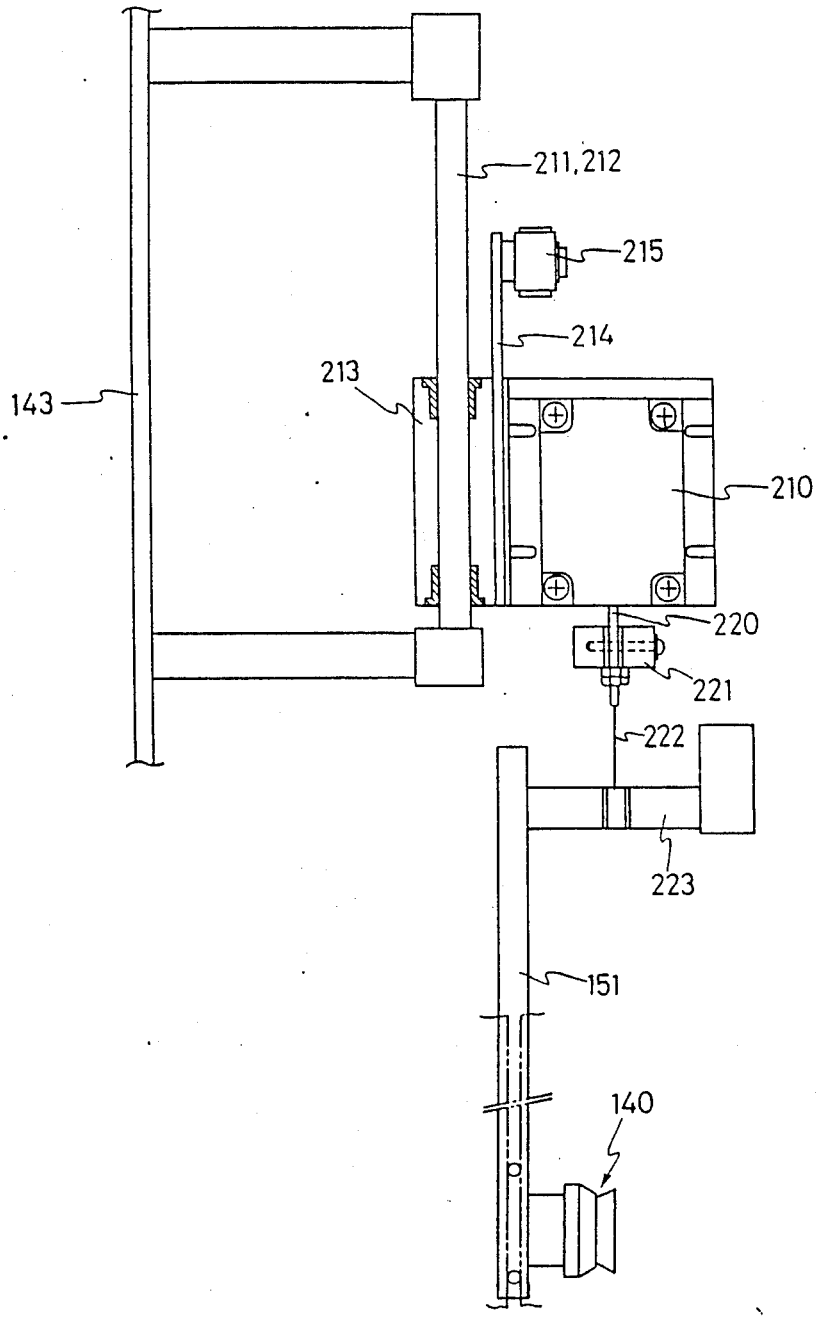
FIG. 25 is a schematic front view showing a construction of a sample yarn strength measuring device.

In FIGS. 5 and 25, a measuring gauge 210 is fixed together with a lever 214 to a lift member 213 which is slidable along fixed guide rods 211 and 212. A roller 215 provided at an end portion of the lever 214 is engaged with a U groove 217 of a cam lever 216. The lift member 213 is adapted to go up and down at a constant stroke through the lever 214 under the action of a cam follower provided intermediately of the cam lever 216 and a cam plate 219. The cam shaft (C) is the same as the cam shaft for driving the upper and lower clamp mechanisms.

From the gauge 210 is suspended a block 221 through a pin 220 which is associated with a known strain meter provided within the gauge. Further, a support member 223 which is integral with the lift plate 151 having the upper clamp mechanism 140 is connected to the block 221 through leaf springs 222.

After both end portions of the sample yarn are clamped in predetermined positions by the above sample yarn setting mechanism, the lever 216 shown in FIG. 5 is pivoted from its solid line position to its dash-double dot line position 216*a* by means of the cam plate. As a result, the lift plate suspended from the gauge 210 goes up along the box member. In this case, the lower end of the sample yarn is clamped and fixed by the lower clamp mechanism 141, so with the ascending motion of the gauge, the strain meter in the gauge is displaced by the yarn tension and the sample yarn will be broken with further ascent of the gauge. The load at the time of yarn breakage is calculated from the amount of displacement of the strain meter and is shown as an electroconverted digital value. The ascending stroke of the gauge 210 should be set as a stroke which permits various yarns to be surely broken. Except special elastic yarns, a stroke of 50 to 100 mm is sufficient. The stroke is also related to the length of sample yarn and the above range of stroke is suitable for yarn samples of 200 to 500 mm in length.

(V) Drive System and Control System

Figure 26:
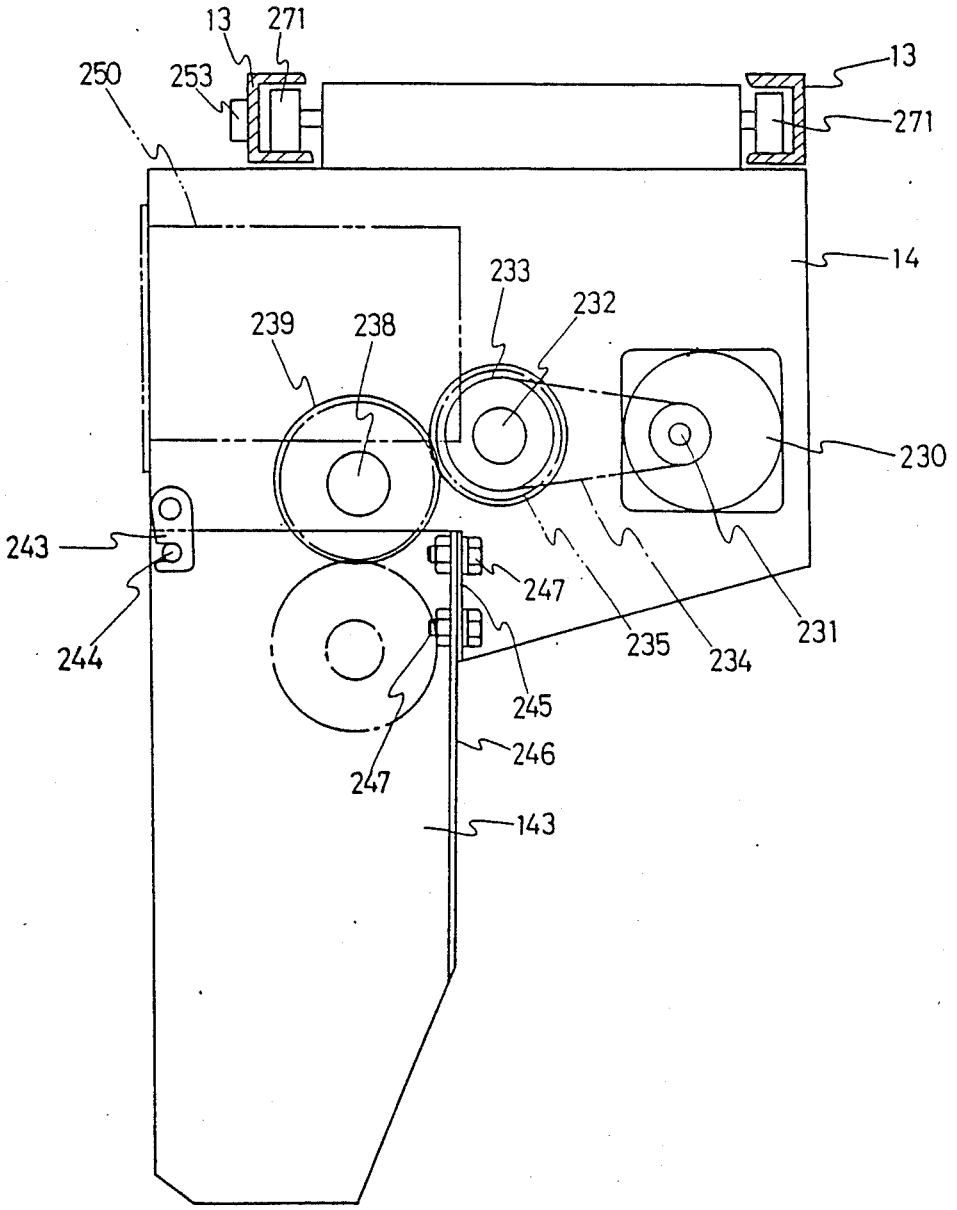
FIG. 26 is a side view showing means for mounting the inspecting apparatus body to a carriage car.
Figure 27:
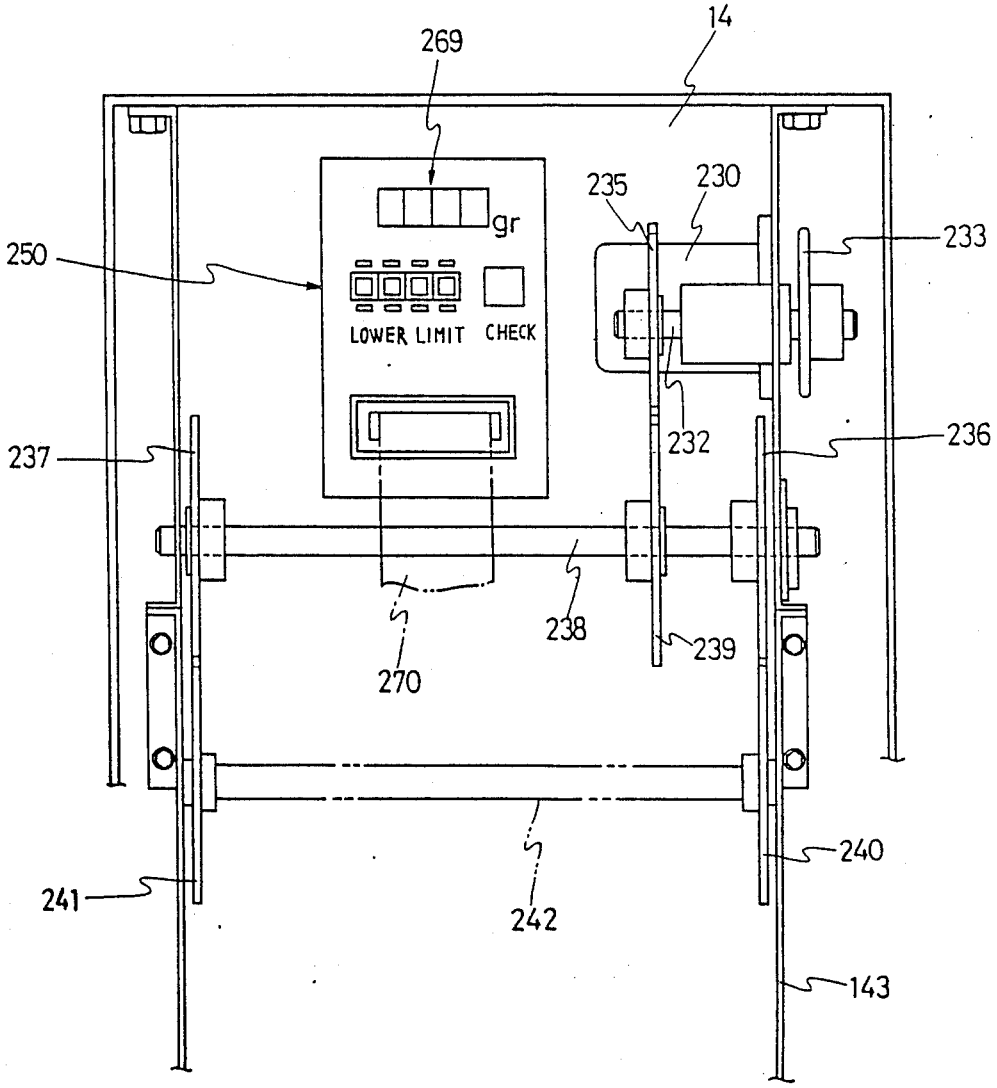
FIG. 27 is a front view thereof.

In FIGS. 26 and 27, the above mechanisms (I) to (IV) are attached to the inspecting apparatus body 143 which is detachable with respect to the carriage car 14, and the drive portion for driving the cam shafts (A), (B) and (C) is mounted on the carriage car 14 side. More specifically, on the carriage car 14 side, a chain 234 is stretched between an output shaft 231 of a drive motor 230 and a sprocket 233 on an intermediate shaft 232, and a gear 235 fixed to the intermediate shaft 232 is in mesh with an intermediate gear 239 on a shaft 238 with output gears 236 and 237 fixed at both ends.

On the other hand, on the body 143 side, there is provided an input shaft 242 having gears 240 and 241 at both ends which gears are in mesh with the output gears 236 and 237. The input shaft 242 corresponds to the shaft 242 in FIG. 2 and it serves as a drive source for the shafts (A), (B) and (C).

As an example, the body 143 is attached to the carriage car 14 in the following manner. A rod 244 fixed on the body 143 side is brought into engagement with a hook 243 which is fixed to a side wall of the carriage car 14, thereby suspending the body 143, and a bent side wall portion 245 of the carriage car and a back portion 246 of the body 143 are fixed together with bolts 247 whereby the body 143 is made detachable. Thus, the body 143 which carries the inspecting apparatus thereon can be removed from the carriage car 14 easily and so the adjustment, inspection and repair of the mechanisms in the inspecting apparatus body can be done in a separated state of the body from the carriage car. Moreover, by removing the body 143 from the carriage car and attaching another body having another function, it becomes possible to attain another function in addition to the above inspecting function. For example, it is possible to attach to the carriage car a body having a function of cleaning a specific position of the take-up unit, a body having a function of measuring vibration and revolution of a traverse drum in the take-up unit, or a body having an automatic doffing function for full-loaded packages. Besides, each body does not require the provision of a drive source. Drive for various functions can be obtained easily if there is provided at least the input gear 240 which is in mesh with the gear 236 shown in FIG. 27.

As shown in FIGS. 26 and 27, on the carriage car 14 is mounted a control box 250 for displaying the results of the above yarn tenacity measurement and controlling the drive and stop of the shaft (A), (B) and (C) and various air supply timings. The control box 250 can also be replaced with another control box according to the function of the body 143. Travelling wheels 271, which are attached to the carriage car 14, are driven by a motor (not shown).

Figure 30:
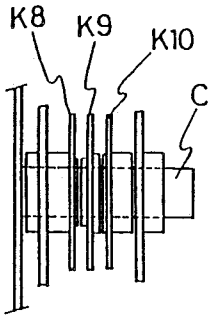
FIG. 30 is a front view showing an arrangement of cams mounted on the shaft (C)
Figure 28:
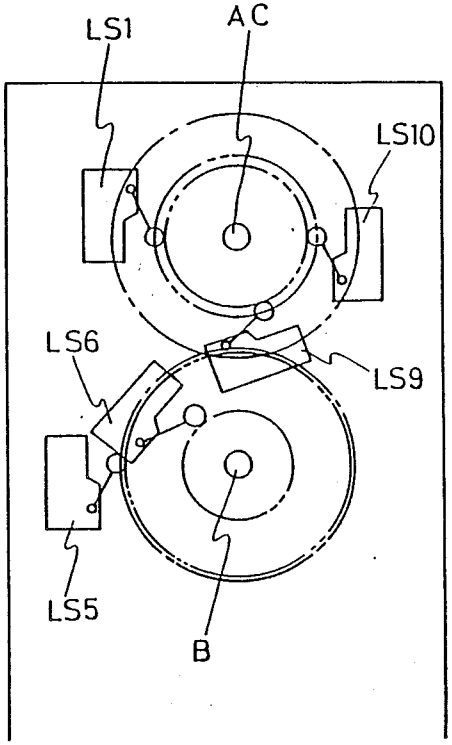
FIG. 28 is a side view showing an arrangement of limit switches which are operated by cams mounted on the cam shafts.
Figure 29:
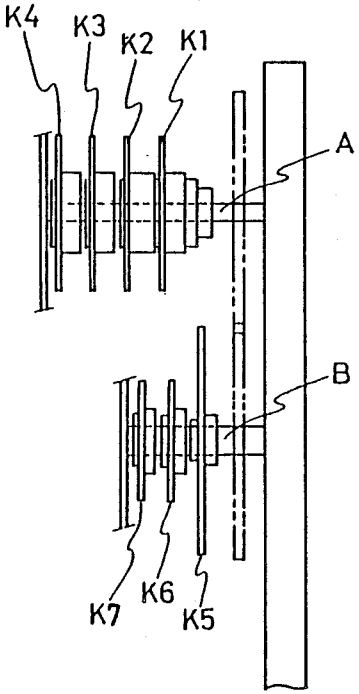
FIG. 29 is a front view showing an arrangement of cams mounted on the shafts (A) and (B)

As shown in FIGS. 28 to 30, in addition to the cams for the mechanism actuating levers mounted on the cam shafts (A), (B) and (C), there are provided limit switches for controlling on-off timing of various mechanisms as well as control cams for operating actuators of those limit switches.

On the shaft (A) are mounted four kinds of cams K1 to K4 shown in FIG. 29 and limit switches LS1 to LS4 in positions shown in FIG. 28 which are turned on and off by the cams. Although the switch LS1 along is shown in FIG. 28, the other switches are also in the same position in side view each corresponding to each cam. The cam K1 is for controlling the electromagnet provided at the fore end of the joining command arm 15 on the take-up unit side shown in FIG. 1. It turns on and off the attracting force of the electromagnet. The cam K2 is for turning on and off the solenoid for driving the shaft (B); the cam K3 is a valve change-over cam for the yarn ejecting air nozzle 131 shown in FIGS. 13 and 14; and the cam K4 is for turning on and off a solenoid 252 for actuating an index plate 251 which performs a stop-positioning of the carriage car shown in FIG. 1.

On the shaft (B) shown in FIG. 29 are mounted three kinds of cams K5 to K7 and limit switches LS5 to LS7 shown in FIG. 28 which are turned on and off by those cams. The cam K5 is for turning on and off the solenoid 79 of the upper yarn cutting and holding device 3 shown in FIG. 7; the cam K7 is a valve change-over cam for the fluid cylinder 116 of the lower yarn cutting and holding device 4 shown in FIGS. 11 to 13; and the cam K6 is for turning on and off the solenoid clutch for driving the shafts (A) and (C).

On the shaft (C) are mounted three kinds of cams K8 to k10 shown in FIG. 30 and limit switches LS8 to LS10 shown in FIG. 28 which are turned on and off by those cams. The cam K8 is for turning on and off the feeler solenoid 193 shown in FIGS. 23 and 24 which detects whether sample yarn is set in the measuring position or not; the cam K10 is for turning a limit switch on only during measurement of yarn, the cam K10 acting in response to an ascending motion of the lift plate 151 shown in FIG. 25; and the cam K9 is for turning on and off the suction pipe 185 shown in FIG. 16 which functions to discharge upper and lower broken yarn wastes after measurement and also turning on and off the air supply valve of the suction pipe 203 shown in FIG. 24.

The following description is now provided about the yarn tenacity measuring operation by the inspecting apparatus having the above mechanisms (I) to (V).

(i) Joining Step

Figure 31:
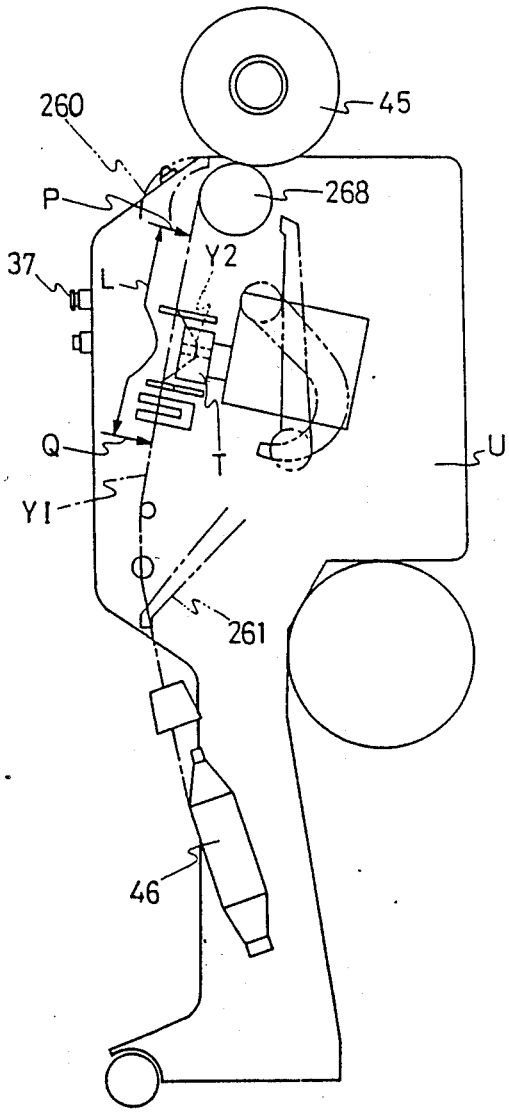
FIG. 31 is a schematic side view showing a construction of a take-up unit in a winder to which is applied the inspecting apparatus of this embodiment.
Figure 32:
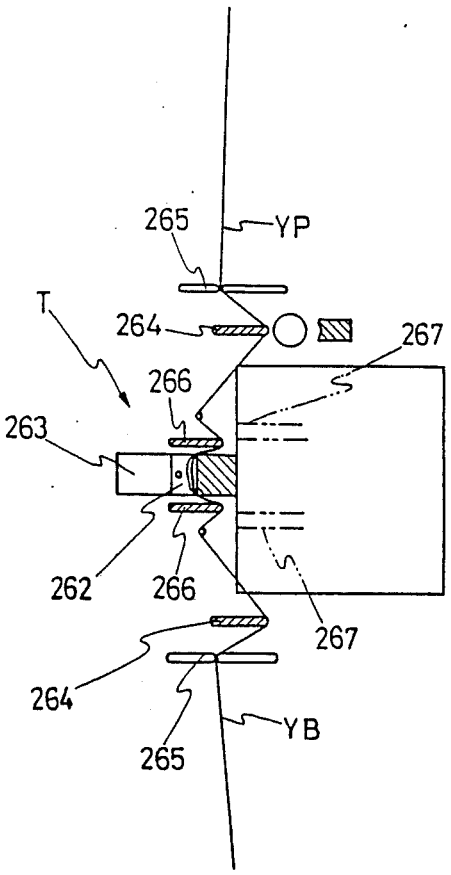
FIG. 32 is a sectional side view showing a pneumatic splicing device attached to the take-up unit and also showing a bent state of yarn under splicing operation by the pneumatic splicing device.

In FIG. 1, when the carriage car 14 moves along the rails 13 and reaches a predetermined position in the take-up unit, the positioning solenoid 252 is turned off and the index plate 251 is turned toward a dog 253 which is fixed in a predetermined position on a rail front face, by virtue of a spring (not shown), and a recess 254 of the plate 251 comes into engagement with the dog 253 to stop the carriage car 14 in a predetermined certain position. A proximity sensor 255 is provided on the carriage car side for detecting a pivotal motion of the index plate, and upon detection of a part 256 of the plate 251, it provides a detected signal. With this detected signal the solenoid (26 in FIG. 3) for driving the shaft (A) in the inspecting apparatus body operates and the cam shaft (A) starts rotating. First, the joining command arm 15 is displaced by the cam 38 shown in FIG. 4 to push in the joining start button 37 on the take-up unit side, so that the joining device on the take-up unit side starts operating. More specifically, as shown in FIG. 31, a yarn end on the side of the take-up package 45 is sucked and held by a suction mouth 260 and is guided to an joining device (T) which is located in a position deviated from a yarn travelling path (Yl). On the other hand, the yarn on the side of the yarn feed bobbin 46 is sucked and held by a relay pipe 261 and is guided to the joining device (T). The joining device (T) used in this embodiment is the foregoing pneumatic splicing device. For example, a package-side yarn end (YP) and a feed bobbin-side yarn end (YB) are introduced into a cylindrical splicing chamber 262 positively by yarn guides 264 through a slit portion 263 adjacent to the chamber 262, then goes through the steps of clamping by clamp portions 265, yarn end cutting, yarn end untwisting, and drawing untwisted yarn ends from untwisting nozzles 267 by yarn pressing levers 266. Splicing operation is performed by the action of an air stream ejected into the splicing chamber 262. During splicing, the yarn is held in a bent condition by various levers, clamp pieces and yarn guides, and after completion of the splicing operation, it comes off the splicing device and takes a normal rectilinear travelling path. In this embodiment, the yarn sampling mechanism starts operating after completion of the splicing operation, so the joining command button 37 is pulled out by the arm 15 and therefore a drum 268 remains off. After the yarn measurement has been completed by a predetermined number of times, the command button is pushed in and the operation transfers to the normal take-up operation after completion of joining.

(ii) Yarn Sampling Step

The control cams 63 and 97 of the yarn sampling mechanism 5 are mounted on the cam shaft (B). The shaft (B) is driven in accordance with a command on the shaft (A) side, and after the lapse of a certain time from the time of issuance of the joining command on the shaft (A) side, the sampling mechanism starts operating. More specifically, the upper movable arm 7 in FIG. 5 and the lower movable arm 8 in FIG. 9 start descending while taking timing by means of the driving cams 63 and 97 for the segment gears 61 and 95. The operation of the yarn cutting and holding devices 3 and 4 attached to the arms 7 and 8 is performed at least prior to the completion of the joining operation. More particularly, the yarn path during joining is bent (Y2) between yarn cutting positions (P) and (Q) in FIG. 31, thus permitting sampling of a long yarn portion.

In a take-up unit which there is a sufficient size in the vertical direction of the joining device (T) and a sufficient length of sample yarn is obtained even if yarn is cut and held in two positions in a state of being positioned along the normal yarn travelling path after completion of the joining operation, it is not necessary to take a severe yarn cutting and holding timing. However, in the case of an automatic winder compactly equipped with various mechanisms, there is no sufficient space, so by cutting and holding both sides of a joint portion within the time period during which the yarn is bent, it is possible to obtain a sample yarn of a length suitable for measurement.

Figure 7:
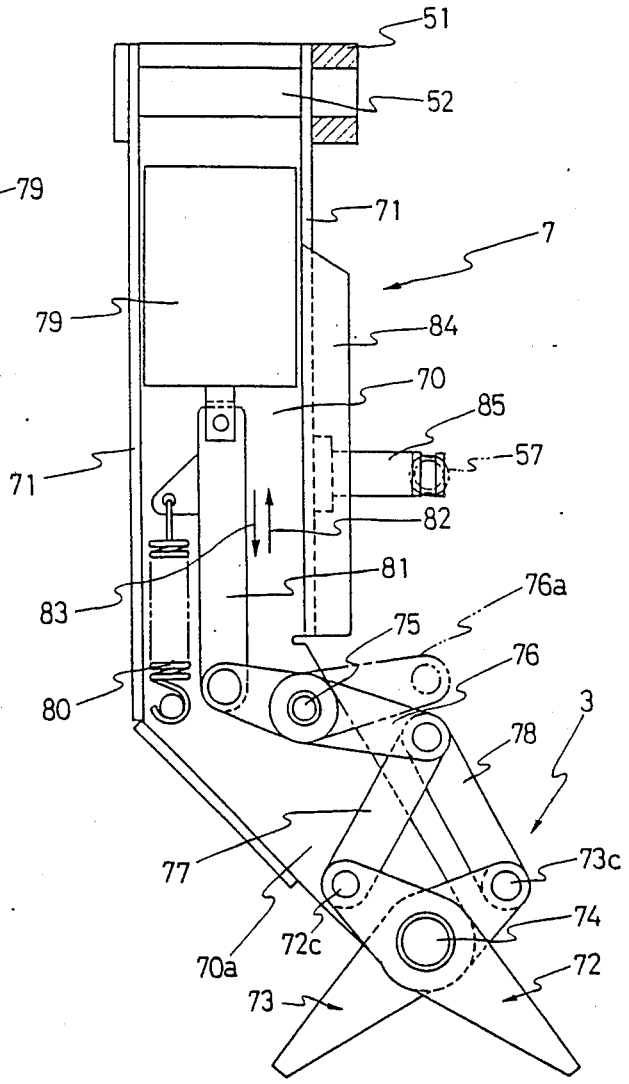
FIG. 7 is a plan view of an upper yarn cutting and holding device.

As previously noted, the upper and lower movable arms 7 and 8 makes a parallel movement from their stand-by positions at the same speed, and at almost the same time as their reaching the yarn cutting positions (P) and (Q) the cutting and holding solenoid 79 shown in FIG. 7 and the fluid cylinder 116 shown in FIG. 13 start operating, whereby yarn is cut and held in the two positions (P) and (Q) as shown in FIG. 31 and the yarn portion located between the holding points is sampled in a slacked condition which slack corresponds to the bent portion.

Therefore, if a linear yarn path distance between the cutting and holding points (P) and (Q) is l, the length (L) of the sample yarn obtained is larger than l.

(iii) Sample Yarn Transfer Step

Then, the upper and lower movable arms 7 and 8 start ascending and the sample yarn is transferred to the measuring position. More specifically, the segment gears 61 and 95 are simultaneously rotated counterclockwise from their solid line positions by the cams 63 and 97 shown in FIGS. 6 and 10 and the upper and lower movable arms 7 and 8 start a parallel movement at approximately the same speed.

Figure 33:
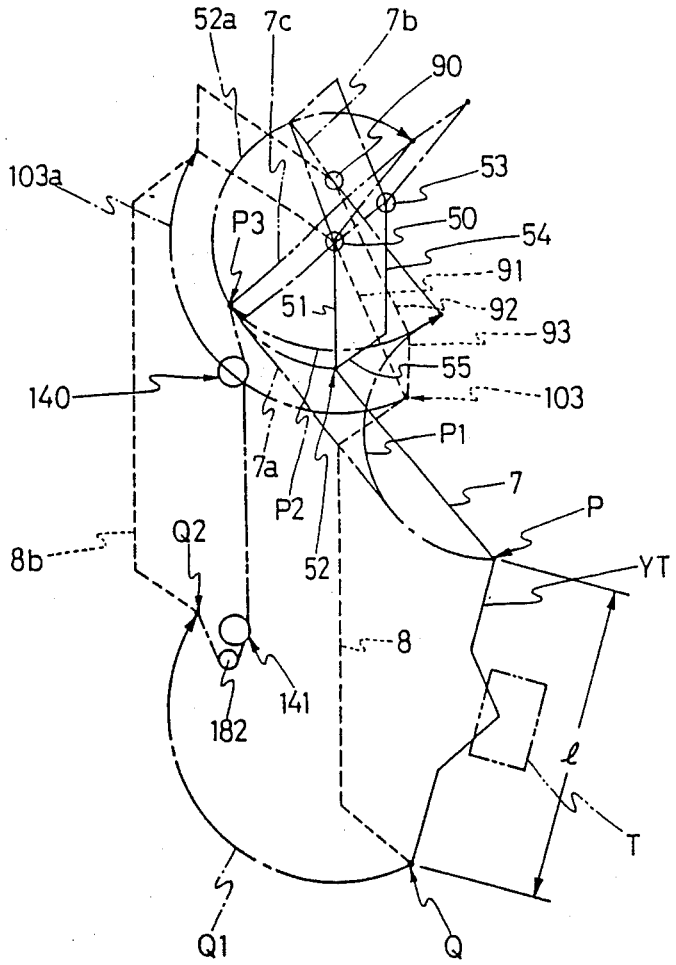
FIG. 33 schematically illustrates moving paths of the upper and lower movable arms (7, 8)

FIG. 33 shows a transfer path of sample yarn (YT). The shaft 50 serves coaxially as a fulcrum of the lever 51 of the upper movable arm 7 and a fulcrum of the lever 91 of the lower movable arm 8. The fulcrum of the other lever 54 of the upper movable arm 7 is the shaft 53 and that of the other lever 92 of the lower movable arm is the shaft 90. Therefore, the upper end holding point (P) of the sample yarn (YT) moves along a path (P1) and an inversional path (P2), while the lower end holding point (Q) of the sample yarn (YT) moves along a path (Q1). Numeral 52*a* represents a moving path of the connection point 52 between the lever 51 and the upper movable arm 7, and numeral 103*a* represents a moving path of the connection point 103 between the lever 91 and the lower movable arm 8.

Since the holding points (P) and (Q) make a substantially parallel movement at about the same speed, no tension is applied to the sample yarn (YT) itself. Even if the shortest linear distance (l) between the holding points (P) and (Q) is changed due to the difference of the moving paths, there is no fear of tension being imposed on the sample yarn itself and causing a change of yarn characteristics or yarn breakage, because there exists a slack capable of absorbing the above variation of the distance. Thus, the sample yarn is transferred to the measuring position without being subject to an external influence.

(iv) Step of Setting to Measuring Position

The sample yarn which has been conveyed near the measuring position is positioned to a predetermined position in the upper clamp mechanism, then the slack of the sample yarn is removed by a slight movement of the lower movable arm, and in this state the upper and lower clamp mechanisms clamp the yarn end portion almost simultaneously.

More specifically, when the upper movable arm 7 in FIG. 5 reaches its dash-double dot line position 7C, the sample yarn (YT) engaged with the holding point of the lower movable arm is guided by the tapered surface formed between the fixed piece 145 and movable piece 146 of the upper clamp mechanism 140 in FIG. 16 and is positioned to a specific position in a natural manner. At this time, the lower movable arm 8 is in its intermediate position 8*a* in FIG. 9, and through a slight time lag after stop of the upper movable arm the arm 8 moves up to its final raised position 8*b*. At this time, the sample yarn (YT) engaged with the holding point of the lower movable arm is wound round the weight roller 182 located below the lower clamp mechanism 141 shown in FIG. 21, and at the time of the final movement of the lower movable arm 8 the roller 182 moves by a distance sufficient to absorb the yarn slack from its solid line position 182 up to a suitable position before the dash-double dot line position 182*b*, to thereby absorb the yarn slack without imparting an overload to the sample yarn.

Thereafter, the upper and lower movable pieces 146 and 148 shown in FIG. 16 are closed by the clamp mechanism actuating cam 170 shown in FIG. 20 and the cam 171 which is coaxial with the cam 170, and thus the clamping of yarn is completed. Thus, the rotation of the cam shaft (C) is started just before the sample yarn is set to the measuring position, and when the sample yarn contacts between the upper movable piece 146, fixed piece 145 and the lower movable piece 148, fixed piece 147, the movable pieces 146 and 148 are in the state of FIG. 18 in which they are opened by an ascent of the rods 168 and 169 in FIG. 16. Upon reaching the predetermined position in the upper and lower clamp mechanisms 140 and 141, as shown in FIG. 16, the sample yarn (YT) is set to the measuring device by operating the movable pieces 146 and 148 in the closing direction. After completion of the sample yarn clamping by the clamp mechanism, the yarn cutting and holding devices 3 and 4 attached to the upper and lower movable arms 7 and 8 are reset and revert to the original state, ready for sampling the next yarn portion for measurement.

(v) Measuring Step

The sample yarn (YT) thus clamped by the upper and lower clamp mechanisms is measured for tenacity after detection of its presence.

More specifically, after completion of the clamping operation, the cam K8 shown in FIG. 30 and a limit switch operate to turn off the solenoid 193 shown in FIGS. 23 and 24, whereupon the feeler 191 shown in FIG. 23 pivots clockwise about the shaft 196 from its solid line position by virtue of the spring 194. Whether yarn is present or not in the predetermined position is judged by the operation mentioned in the foregoing (III). The cam shaft (C) rotates once independently of whether yarn is present or not and the measuring operation is performed. But, in the absence of yarn, it is judged that the measurement is impossible, and this state is once stored in a memory provided within the control box. In the case where such an infeasible state of measurement is detected two or three times continuously, the take-up unit concerned is regarded as being measurement-infeasible, and the inspection advances to the next take-up unit while allowing the joining command button 37 on the take-up unit side to be projecting.

In the case where the feeler 191 has judged that yarn is present, a measured value is processed in the control box with the yarn measuring operation and a tenacity value is displayed on a display portion of the control box 250 shown in FIG. 27 or it is written onto a recording paper 270.

In the above measuring operation, the sample yarn is measured for tenacity by an integral rise of the lift plate 151 having the upper clamp mechanism 140 shown in FIGS. 5 and 25 with the gauge 210 which is effected by the cam 219 and cam lever 216. More particularly, the lower end portion of the sample yarn (YT) which has a joint portion approximately centrally is clamped by the fixed lower clamp mechanism 141, so a load induced by tension is imposed on the yarn (YT) with the rising motion of the lift plate, and the known strain meter disposed within the gauge 210 is displaced in proportion to the said load. When the gauge 210 rises up to the position in which the joint portion of the sample yarn is finally broken, the maximum displacement of the strain meter which occurred at the point of breakage is converted to a load value and a yarn strength is displayed digitally as gram number.

(vi) Yarn Waste Discharging Step

Upon completion of the yarn strength measurement in the above step, the lift plate 151 shown in FIG. 16 goes down to the original lowermost position. Subsequently, by the action of the suction pipe valve cam K9 mounted on the shaft (C) shown in FIG. 30 and a microswitch, pressurized air is fed into the yarn waste removing suction pipes disposed near the upper and lower clamp positions, namely, the upper yarn waste suction pipe 203 shown in FIGS. 23 and 24 and the lower yarn waste suction pipe 185 shown in FIG. 16, and an attractive force is exerted on the opening portions 203*a* and 185*a* of the suction pipes 203 and 185. Further, when the lift member 151 having the upper clamp mechanism reaches its lowermost position, the cam lever 175 shown in FIG. 20 is positioned on the cam surface 172 and the rods 168 and 169 for pressing the movable pieces 146 and 148 of the clamp mechanisms 140 and 141 are pulled up in the direction of arrow 271 in FIG. 16 to push the movable pieces 146 and 148 to thereby release the yarn waste holding. Since the attractive forces from the suction pipes 203 and 185 are already exerted on the areas just under the movable pieces, the yarn wastes thus unclamped are sucked into the suction pipes 203 and 185 and stored into the yarn waste storage box 204 which is connected to the suction pipe discharge ports.

A single sample yarn measuring cycle is completed in this way. The above operation is repeated plural times in one take-up unit position to measure the strength of a seam portion after going through the joining device attached to the take-up unit. The result of the measurement is processed and recorded in the control box 250 shown in FIG. 27.

After the measurement is made by a preset number of times, the solenoid 252 for deactuating the index plate 251 shown in FIG. 1 operates to disengage the plate 251 from the dog 253 and a motor (not shown) for moving the carriage car operates to start transfer to the next take-up unit.

Figure 34:
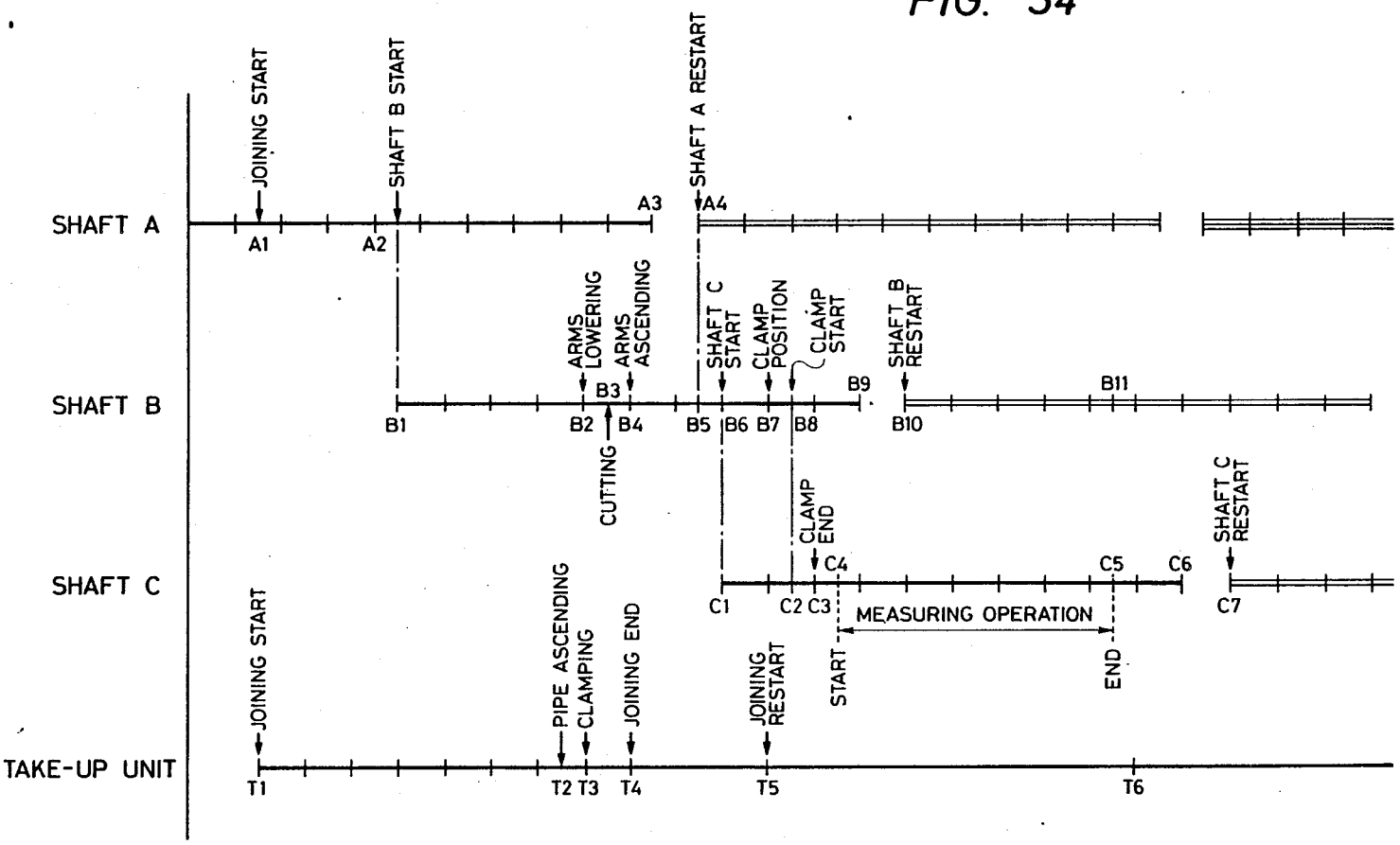
FIG. 34 is a basic time chart showing a yarn measuring process which is carried out by the inspecting apparatus.

FIG. 34 shows a relation between the operation of the cam shafts (A), (B) and (C) for executing the above steps and operation timings of the component mechanisms as well as operation timings of the joining device.

The time chart of FIG. 34 shows the case where the joining command button (37 in FIG. 1) is already in its projected position in a take-up unit and an joining device operates in accordance with the first operation of the joining command arm 15 in which the arm 15 moves from its stand-by position 15*a* in FIG. 4 to its operating position 15 indicated by a solid line. The lapse of time is plotted in the lateral direction which is partitioned at every second.

When the carriage car reaches a predetermined position, the shaft (A) starts to rotate, and after 1.5 seconds, the joining operation is started (A1) by operation of the joining command arm 15 to start the joining device (T1) in a take-up unit. Then, during the joining operation, the shaft (B) is operated (B1) by a control cam provided on the shaft (A) and the upper and lower movable arms 7 and 8 start descending. At this time, the joining operation is still continued and the shaft (C) remains stopped. When the upper and lower movable arms 7 and 8 reach the lowermost positions, namely, the yarn sampling position (B2), the yarn portions on both sides of the joining device are clamped in certain positions (T3) and in a bent state. Thereafter, the yarn cutting and holding devices 3 and 4 attached to the upper and lower movable arms 7 and 8 operate to cut and hold the yarn (B3). After completion of the joining operation (T4), the upper and lower movable arms 7 and 8 start ascending (B4) to start transfer of the sample yarn. During this transfer of the sample yarn, the shaft (A) and the shaft (C) through a timer are operated by a cam provided on the shaft (B) (K6 in FIG. 29) (A4) (Cl). Thus, the joining operation (T5) for sampling the next yarn can be done simultaneously with the measuring operation for the yarn already sampled.

When the upper and lower movable arms 7 and 8 reach the clamp mechanism at the measuring position (B7), Clamp Start (C2) and End (C3) are controlled by the cam shaft (C) and measurement is started (C4) after clamp end. During the measurement (C4)-(C5), restart (B10) of the shaft (B) is effected by the cam on the shaft (A) side whereby the sampling of yarn is again performed simultaneously with the measuring operation. Therefore, at the end of measurement (C5) the next sample yarn is already obtained (B11) and thus the measuring operation is executed successively intermittently. In the case of the above embodiment, 20 seconds are required for the first measurement, but from the second measurement et seq. the time required from the end of one measurement up to the end of the next measurement is 11 seconds and thus the measuring operation can be done extremely efficiently. The reason is that the joining command mechanism, the yarn sampling and transferring mechanism and the measuring mechanism are operated by separate drive shafts. For example, where all the above mechanisms are operated by a single drive shaft, the next joining start (T5) is commanded only after the measurement end (C5) in FIG. 34.

Figure 35:
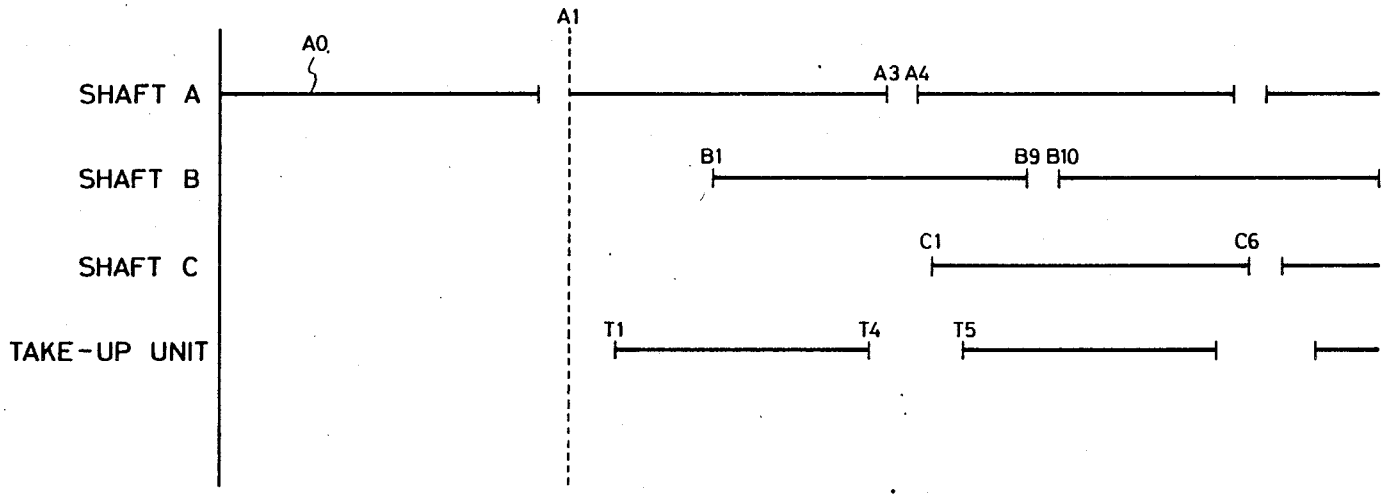
FIG. 35 is a time chart of measurement in a winder which is actually in operation.

The operation timings of the above mechanisms can be changed according to the kind of the joining device or of the measuring device used. That is, the entire cycle time can be changed easily by changing the rotating speeds of the cam shafts (A), (B) and (C) synchronizedly.

Where the take-up unit for inspection is under take-up operation, the first command button depressing operation of the joining command arm 15 does not cause the joining device to operate as mentioned in the foregoing (I). The joining operation is started only by the second depressing operation of the arm. Because of different joining start points, there occurs a timing error in the sampling operation. To avoid this, only the shaft (A) is allowed to perform a single lost motion in the case of a take-up unit under take-up operation. That is, such a time chart as shown in FIG. 35 is obtained, in which after a single rotation (A0) of only the shaft (A) the same operation of each shaft as in FIG. 34 is started after the broken line (A1).

According to the present invention, as set forth hereinabove, the strength of a joint formed by a joining device attached to each take-up unit in a winder can be measured automatically, and particularly in the case of a winder in which a large number of take-up units are arranged side by side, the time required for inspection can be greatly shortened as compared with that in the conventional manual operation.

What is claimed is:

1. An automatic inspecting apparatus for a yarn joining device, comprising:

a joining command mechanism for providing a yarn joining operation starting command to the yarn joining device disposed on the side of a take-up unit;

a sampling mechanism for cutting and holding a portion of the yarn joined by said yarn joining device as a sample yarn, said sample yarn including a joint portion after joining;

a transfer mechanism for transferring said sample yarn to a measuring position;

a setting mechanism for clamping and holding the sample yarn in a predetermined measuring position; and a measuring mechanism for measuring characteristics of the sample yarn, wherein a carriage car is provided to move on rails which extend along take-up units and said joining command mechanism, said sampling mechanism, said transfer mechanism, said setting mechanism and said measuring mechanism are attached to an inspecting apparatus body which is detachable with respect to the carriage car.

2. An apparatus as claimed in claim 1, wherein said mechanisms are driven by a driving device including cam shafts which are each disposed separately and turned on and off through a rotating gear and a clutch mechanism.

3. An apparatus as claimed in claim 1, wherein said measuring mechansim is a general tension tester.

4. An automatic inspecting apparatus for a yarn joining device, comprising:

a joining command mechanism for providing a yarn joining operation starting command to the yarn joining device disposed on the side of a take-up unit;

a sampling mechanism for cutting and holding a portion of the yarn joined by said yarn joining device as a sample yarn, said sample yarn including a joint portion after joining;

a transfer mechanism for transferring said sample yarn to a measuring position;

a setting mechanism for clamping and holding the sample yarn in a predetermined measuring position; and a measuring mechanism for measuring characteristics of the sample yarn;

wherein said joining command mechanism comprises a command arm supported privotably by a fixed shaft, an attracting member which is an electromagnet attached to a fore end of the arm and which functions to push in and out a joining control button adjacent said take-up unit, a cam plate for pivoting the arm, a cam follower provided at an upper end of a cam lever integral with the arm and a spring which causes the cam lever to follow a cam surface of the cam plate, said arm being changed in position by the cam plate.

5. An automatic inspecting apparatus for a yarn joining device, comprising:

a joining command mechanism for providing a yarn joining operation starting command to the yarn joining device disposed on the side of a take-up unit;

a sampling mechanism for cutting and holding a portion of the yarn joined by said yarn joining device as a sample yarn, said sample yarn including a joint portion after joining;

a transfer mechanism for transferring said sample yarn to a measuring position;

a setting mechanism for clamping and holding the sample yarn in a predetermined measuring position; and a measuring mechanism for measuring characteristics of the sample yarn, wherein said sampling mechanism and said transfer mechanism comprise an upper yarn cutting and holding device which is attached to a first movable arm arranged at a take-up package side, and a lower yarn cutting and holding device which is attached to a second movable arm arranged at a yarn feed bobbin side.

6. An apparatus as claimed in claim 5, wherein said first movable arm is pivoted by a first lever which is pivotably supported by a first fixed shaft, while a bar is pivoted between the first lever and a second lever which is pivotably supported by a second fixed shaft, to form a link mechanism, said first movable arm and the bar being moved in parallel at a certain angle up to a specific position and said first movable arm being revolved after passing the specific position.

7. An apparatus as claimed in claim 6, wherein a gear integral with the first lever is loosely fitted on the first fixed shaft, a segment gear meshing with the gear is supported pivotably about a third fixed shaft and a cam follower which is in pressure contact with a cam surface of a cam plate for moving the first movable arm is supported at an intermediate arm portion of the segment gear.

8. An apparatus as claimed in claim 5, wherein said upper yarn cutting and holding device includes two movable members which are coaxially pivoted and each of which comprises a cutter plate and a clamp plate integrally pivoted through a predetermined gap, a solenoid and lever means for connecting the movable members with the solenoid.

9. An apparatus as claimed in claim 5, wherein said second movable arm is integrally fixed to a connecting bar connected between a pair of levers which are pivotally secured to fixed shafts so that a link mechanism is constituted by the levers and the bar and the second movable arm moves in tandem with said link mechanism.

10. An apparatus as claimed in claim 9, wherein a gear integral with one of the levers is loosely fitted on the fixed shaft and the gear is meshed with a segment gear which is pivoted and driven by engagement of a cam plate for operating the second movable arm with a cam follower provided on the segment gear side.

11. An apparatus as claimed in claim 5, wherein said first movable arm and said second movable arm are driven by gears, respectively and the gears are of the same diameter and same number of teeth to be rotated at the same speed so that the first and second movable arms make parallel movements substantially at the same speed permitting movement while holding both ends of a sample yarn at a certain distance.

12. An apparatus as claimed in claim 5, wherein said lower yarn end cutting and holding device comprises a bracket fixed to the lower movable arm and having a yarn guide V groove formed in the bottom thereof, a movable member which is pivotably supported on the bracket at one side of the V groove and a fixed member which is suported on the bracket at another side of the V groove and is composed of two plates fixed so as to form a gap therebetween to permit admission of the movable member between the plates, one of said plates being a cutter plate.

13. An apparatus as claimed in claim 5 further comprising a yarn detecting device adjacent said joining device, an air jet nozzle attached to the second movable arm to be disposed between the lower yarn cutting and holding device and the yarn detecting device, wherein air is ejected from an opening of the nozzle toward the yarn after completion of joining and in a direction in which the yarn does not enter a slit of the yarn detecting device.

14. An automatic inspecting apparatus for a yarn joining device, comprising:

a joining command mechanism for providing a yarn joining operation starting command to the yarn joining device disposed on the side of a take-up unit;

a sampling mechanism for cutting and holding a portion of the yarn joined by said yarn joining device as a sample yarn, said sample yarn including a joint portion after joining;

a transfer mechanism for transferring said sample yarn to a measuring position;

a setting mechanism for clamping and holding the sample yarn in a predetermined measuring position; and a measuring mechanism for measuring characteristics of the sample yarn, wherein said setting mechanim for setting the transferred sample yarn to a measuring position comprises an upper clamp mechanism for clamping an upper end portion of the sample yarn, a lower clamp mechanism for clamping a lower end portion of the sample yarn and a drive mechanism for driving said upper and lower clamp mechanisms, said upper and lower clamp mechanisms being provided on the side of a box member of the inspecting apparatus and said upper clamp mechanism being movable in a vertical direction along the box member.

15. An apparatus as claimed in claim 14, wherein each of said upper and lower clamp mechanisms includes a fixed piece, a movable piece for clamping a yarn between it and the fixed piece, and an actuating lever for actuating the movable piece, said fixed piece having a center hole and a conical recess and said movable piece having a rod extending through the center hole and a conical convex-like face formed to be in close contact with the conical recess of the fixed piece.

16. An apparatus as claimed in claim 15, wherein said actuating lever associated with said upper clamp mechanism and said actuating lever associated with said lower clamp mechanism each has a pressing face in a position opposed to the rod of the movable piece and is pivotally secured to the box member and includes an actuating rod connected to the actuating lever capable of being moved up and down by a cam mechanism provided to drive both of the upper and lower clamp mechanisms, respectively, whereby the movable pieces are operated and closed in synchronism therewith to clamp the upper and lower yarn end portions.

17. An apparatus as claimed in claim 14, wherein said setting mechanism further includes a detecting device for detecting whether a sample yarn is set in the measuring position or not, said detecting device being disposed under the lowermost position of the upper clamp mechanism and having a feeler having a hook portion capable of being displaced by the tension of the sample yarn, a solenoid for operating the feeler and a spring which imparts a weak urging force to the feeler.

* * * * *